US010449786B2

(12) United States Patent
Okayama

(10) Patent No.: US 10,449,786 B2
(45) Date of Patent: Oct. 22, 2019

(54) IMAGE FORMING SYSTEM

(71) Applicant: FUJIFILM Corporation, Tokyo (JP)

(72) Inventor: Yoshiyuki Okayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/027,274

(22) Filed: Jul. 4, 2018

(65) Prior Publication Data

US 2018/0319180 A1 Nov. 8, 2018

Related U.S. Application Data

(63) Continuation of application No. PCT/JP2017/000319, filed on Jan. 6, 2017.

(30) Foreign Application Priority Data

Jan. 12, 2016 (JP) ..... 2016-003828

(51) Int. Cl.
*B41J 11/00* (2006.01)
*B41J 13/00* (2006.01)
(Continued)

(52) U.S. Cl.
CPC ..... *B41J 11/0085* (2013.01); *B41J 2/01* (2013.01); *B41J 11/0025* (2013.01);
(Continued)

(58) Field of Classification Search
CPC ..... B41J 11/0085; B41J 2/01; B41J 13/0054; B41J 13/226; B41J 11/0025
(Continued)

(56) References Cited

U.S. PATENT DOCUMENTS 9,776,431 B2 * 10/2017 Uemura ..... B41J 11/0045
2002/0041068 A1 4/2002 Madsen et al.
2013/0162742 A1 6/2013 Inoue et al.

FOREIGN PATENT DOCUMENTS

JP 2000191175 7/2000
JP 2001026152 1/2001
(Continued)

OTHER PUBLICATIONS

"International Search Report (Form PCT/ISA/210) of PCT/JP2017/000319", dated Mar. 21, 2017, with English translation thereof, pp. 1-5.
(Continued)

*Primary Examiner* — An H Do
(74) *Attorney, Agent, or Firm* — JCIPRNET

(57) ABSTRACT

An image forming system includes a transport section that includes a support surface supporting a sheet-like medium and transports the medium while supporting the medium on the support surface, a first pressure generating section that generates pressure used to suck the medium supported on the support surface, and an image forming section that forms an image on the medium transported by the transport section. First suction holes that communicate with the first pressure generating section, first protrusions, and sealed portions that are disposed at positions where end portions of the medium in the medium width direction are supported and restrict inflow of air to regions, in which the first suction holes are arranged, from the outside of the end portions of the medium in the medium width direction are arranged on the support surface in a medium support region where the medium can be supported.

11 Claims, 16 Drawing Sheets

(51) Int. Cl.

| | |
|---|---|
| ***B41J 2/01*** | (2006.01) |
| ***B65H 5/12*** | (2006.01) |
| ***B41J 13/22*** | (2006.01) |

(52) U.S. Cl.
CPC ..... *B41J 13/0054* (2013.01); *B41J 13/226* (2013.01); *B65H 5/12* (2013.01); *B41J 2202/12* (2013.01); *B65H 2406/332* (2013.01); *B65H 2801/21* (2013.01)

(58) Field of Classification Search
USPC ..... 347/101, 102, 104
See application file for complete search history.

(56) References Cited

FOREIGN PATENT DOCUMENTS

| | | |
|---|---|---|
| JP | 2007144848 | 6/2007 |
| JP | 2011020377 | 2/2011 |
| JP | 2011032036 | 2/2011 |
| JP | 2012096863 | 5/2012 |
| JP | 2013151149 | 8/2013 |

OTHER PUBLICATIONS

"Written Opinion of the International Searching Authority of PCT/JP2017/000319" with English translation thereof, dated Mar. 21, 2017, p. 1-p. 9.
"Office Action of Japan Counterpart Application", dated Apr. 1, 2019, with English translation thereof, p. 1-p. 7.

* cited by examiner

IMAGE FORMING SYSTEM

CROSS-REFERENCE TO RELATED APPLICATIONS

The present application is a Continuation of PCT International Application No. PCT/JP2017/000319 filed on Jan. 6, 2017 claiming priority under 35 U.S.C § 119(a) to Japanese Patent Application No. 2016-003828 filed on Jan. 12, 2016. Each of the above applications is hereby expressly incorporated by reference, in their entirety, into the present application.

BACKGROUND OF THE INVENTION

1. Field of the invention

The present invention relates to an image forming system, and more particularly to a technique for transporting a medium.

2. Description of the Related Art

A system where the stable transport of mediums in various states is realized since protrusions are arranged on a support surface where a medium is sucked and supported during the transport of the medium is known in an image forming system that forms an image on a sheet-like medium.

That is, since protrusions are arranged on a support surface where a medium is sucked and supported, the deformation of the medium can be absorbed between the protrusions even though the medium to be transported is significantly deformed. Accordingly, creases, floating, and the like can be suppressed, so that the stable transport of the medium can be realized.

An invention disclosed in JP2013-151149A is an image forming system that transports a medium while sucking and supporting the medium and prevents creases and floating of a medium since lattice-shaped protrusions are formed on the surface of a transport drum where a medium is sucked and supported and suction holes are disposed in recessed portions between the protrusions. Further, JP2013-151149A discloses that suction holes are disposed in the protrusions.

The term of the "image forming system" in this specification corresponds to the term of an "ink jet recording apparatus" disclosed in JP2013-151149A. The term of the "suction hole" in this specification corresponds to the term of the "suction hole" disclosed in JP2013-151149A. The term of the "protrusion" in this specification corresponds to the term of a "protruding portion" disclosed in JP2013-151149A. The term of the "medium" in this specification corresponds to the term of a "medium" disclosed in JP2013-151149A.

JP2000-191175A discloses an image forming system that transports a medium while sucking the medium and has an effect of reducing the flapping height of the medium since suction holes and protrusions are arranged on a surface where the medium is sucked and supported.

The term of the "image forming system" in this specification corresponds to the term of a "recording apparatus" disclosed in JP2000-191175A. The term of the "suction hole" in this specification corresponds to the term of an "air inflow hole" disclosed in JP2000-191175A. The term of the "protrusion" in this specification corresponds to the term of a "protruding portion" disclosed in JP2000-191175A. The term of the "medium" in this specification corresponds to the term of a "sheet" disclosed in JP2000-191175A.

SUMMARY OF THE INVENTION

However, since air flows in at the end portions of the medium in the medium width direction in a case in which protrusions are arranged on the entire support surface where a medium is sucked and supported in the image forming system that transports a medium while sucking and supporting the medium, suction pressure is reduced at the end portions of the medium. A.s a result, the floating of the medium is likely to occur at the end portions of the medium.

In the image forming system disclosed in JP2013-151149A, air present outside the end portions of a medium is sucked through the suction holes from portions, which are not closed by the medium in regions surrounded by the lattice-shaped protrusions, in a case in which all the lattice-shaped protrusions are not closed by the medium at the end portions of the medium. For this reason, suction pressure applied to the end portions of the medium is reduced.

Accordingly, the floating of the medium is likely to occur at the end portions of the medium.

In the image forming system disclosed in JP2000-191175A, the structure of the suction holes and the structure of the protrusions are described but the arrangement of the suction holes on the support surface and the arrangement of the protrusions on the support surface are not described.

In the image forming system disclosed in JP2000-191175A, as in the image forming system disclosed in JP2013-151149A, air present outside the end portions of a medium is sucked in a case in which regions of all the recessed portions surrounded by the protrusions are not closed by the medium at the end portions of the medium. For this reason, suction pressure applied to the end portions of the medium is reduced. Accordingly, it is difficult to avoid the floating of the medium and a reduction in the suction pressure for the medium.

The invention has been made in consideration of the above-mentioned circumstances, and an object of the invention is to provide an image forming system in which protrusions capable of suppressing creases and floating, which are to be generated on a medium, are arranged on a support surface supporting a medium, the floating of end portions of a medium in a medium width direction orthogonal to a medium transport direction is suppressed, and the stable transport of a medium can be realized.

The following aspects of the invention are provided to achieve the object.

An image forming system of a first aspect comprises a transport section that includes a support surface supporting a sheet-like medium and transports the medium while supporting the medium on the support surface, a first pressure generating section that generates pressure used to suck the medium supported on a medium support region of the support surface, and an image forming section that forms an image on the medium transported by the transport section. The medium support region has a structure in which first suction holes communicating with the first pressure generating section are arranged and a structure in which first protrusions to be arranged in a region where the first suction holes are not arranged are arranged, and sealed portions for restricting inflow of air to the first suction holes from the outside of end portions of the medium in a medium width direction, which is a direction orthogonal to a medium transport direction serving as a direction in which the medium is transported by the transport section, are disposed in regions where the end portions of the medium in the medium width direction are supported.

According to the first aspect, since the inflow of air at the end portions of the medium in the medium width direction is restricted by the sealed portions, the leakage of suction pressure applied to the medium is suppressed. Accordingly, the floating of the end portions of the medium in the medium width direction is suppressed. Further, since the floating of the end portions of the medium in the medium width direction is suppressed, the stable transport of the medium is realized.

The end portion of a medium is a region of a medium that has a predetermined length from an end of the medium. The predetermined length can be determined in terms of whether or not an effective functional effect is obtained.

An aspect that includes a first pressure generating device, a first pipe, and a first flow passage formed in the transport section can be employed as the first pressure generating section.

According to a second aspect, in the image forming system of the first aspect, each of the sealed portions may include second protrusions that are arranged in the medium support region at a position where the end portion of the medium in the medium width direction is supported, second suction holes that are disposed at distal ends of the second protrusions, and a second pressure generating section that communicates with the second suction holes.

According to the second aspect, since the second protrusions including the second suction holes are employed as the sealed portions, the end portions of the medium in the medium width direction are sucked by suction pressure generated in the second suction holes and are supported.

In the second aspect, an aspect that includes a second pressure generating device, a second pipe, and a second fluid flow passage formed in the transport section can be employed as the second pressure generating section.

In the second aspect, the first pressure generating device (or the second pressure generating device) can double as the second pressure generating device (or the first pressure generating device).

According to a third aspect, in the image forming system of the second aspect, the first suction holes may not be arranged in the sealed portions.

According to the third aspect, in the aspect that includes the second protrusions as the sealed portion, the leakage of suction pressure from spaces between the first and second protrusions or spaces between the second protrusions is suppressed since the first suction holes are not arranged in the sealed portions.

According to a fourth aspect, in the image forming system of the first aspect, each of the sealed portions may include a third protrusion that is disposed in a region where the end portion of the medium in the medium width direction is supported and has a length corresponding to a length of the medium in the medium transport direction.

According to the fourth aspect, since the third protrusions are employed as the sealed portions, the leakage of suction pressure at the end portions of the medium in the medium width direction is suppressed.

In the fourth aspect, each of the third protrusions may be integrally formed along the medium transport direction. Further, each of the third protrusions may be divided into two or more third protrusions in a direction crossing the medium transport direction. The two or more third protrusions may be arranged so as to be in contact with each other, The two or more third protrusions may be arranged at intervals.

According to a fifth aspect, in the image forming system of the fourth aspect, the third protrusions may be disposed at positions where ends of the medium in the medium width direction are supported.

According to the fifth aspect, since the third protrusions are disposed at positions where ends of the medium in the medium width direction are supported, the inflow of air from the outside of the medium can be suppressed at the positions where the ends of the medium in the medium width direction are supported.

According to a sixth aspect, in the image forming system of the fourth or fifth aspect, the third protrusion may have a length that is equal to or longer than the length of the medium in the medium transport direction.

According to the sixth aspect, the leakage of suction pressure for the end portions of the medium in the medium width direction is suppressed over the entire length of the medium in the medium transport direction.

According to a seventh aspect, in the image forming system of any one of the fourth to sixth aspects, the first suction holes may be arranged in the sealed portions.

According to the seventh aspect, in a case in which the third protrusions are employed as the sealed portions, a reduction in the suction pressure for the medium at the sealed portions is suppressed by the first suction holes arranged in the sealed portions.

According to an eighth aspect, in the image forming system of any one of the first to seventh aspects, the first protrusions may be arranged on the sealed portions.

According to the eighth aspect, the deformation of the medium is suppressed even at the sealed portions.

According to a ninth aspect, in the image forming system of any one of the first to eighth aspects, the sealed portions may be arranged at a plurality of positions so as to correspond to a plurality of sizes of mediums.

According to the ninth aspect, the floating of the end portions of the medium in the medium width direction is suppressed with regard to a plurality of sizes of mediums.

According to a tenth aspect, in the image forming system of any one of the first to ninth aspects, the transport section may have a structure in which a suction sheet is laminated on a surface of a body part, and the first protrusions, the first suction holes, and the sealed portions may be arranged on a surface of the suction sheet that forms the support surface.

According to the tenth aspect, the body part and the suction sheet can be formed of different members in the transport section. In a case in which the body part and the suction sheet are formed of different members, the simplification of steps of manufacturing the transport section is realized.

Further, the body part and the suction sheet can also be made of different materials.

A metal material, such as stainless steel, can be applied to the suction sheet of the tenth aspect.

According to an eleventh aspect, in the image forming system of the tenth aspect, the transport section may include an attachment/detachment unit that attaches and detaches the suction sheet to and from the body part.

According to the eleventh aspect, the suction sheet can be replaced.

An aspect in which suction sheets corresponding to the plurality of sizes of mediums are provided and the suction sheet is replaced in a case in which the size of a medium is to be changed can be employed in the eleventh aspect.

According to a twelfth aspect, in the image forming system of any one of the first to eleventh aspects, the transport section may include a transport drum which has a cylindrical shape and of which an outer peripheral surface of the cylindrical shape forms the support surface.

According to the twelfth aspect, the floating of the end portions of the medium in the medium width direction is suppressed in a transport drum-transport system in which a medium is supported on a curved surface.

According to the invention, since the inflow of air at the end portions of the medium in the medium width direction is restricted by the sealed portions, the leakage of suction pressure applied to the medium is suppressed. Accordingly, the floating of the end portions of the medium in the medium width direction is suppressed. Further, since the floating of the end portions of the medium in the medium width direction is suppressed, the stable transport of the medium is realized.

DESCRIPTION OF THE PREFERRED EMBODIMENTS

Figure 1:
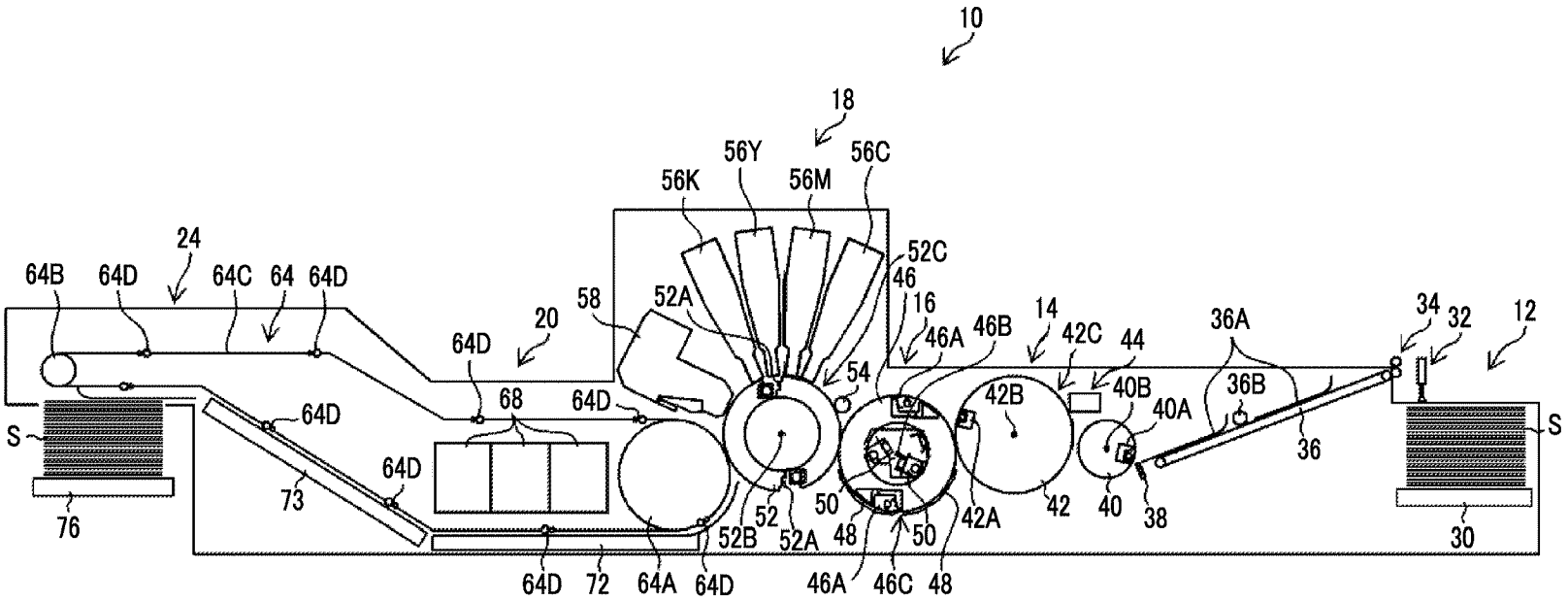
FIG. 1 is a diagram showing the overall structure of an ink jet recording apparatus.

Preferred embodiments of the invention will be described in detail below with reference to the accompanying drawings. In this specification, components having been already described will be denoted by the same reference numerals and the description thereof will be properly omitted.

[Overall Structure of Image Forming System]

First, the overall structure of an image forming system will be described. In this embodiment, an ink jet recording apparatus is exemplified as the image forming system. FIG. 1 is a diagram showing the overall structure of an ink jet recording apparatus.

The ink jet recording apparatus 10 shown in FIG. 1 is an ink jet recording apparatus that draws an image on a sheet S with inks by an ink jet system.

In this specification, the term of "ink" can be properly substituted with the terms of "liquid". The sheet S is an aspect of a medium.

The ink jet recording apparatus 10 mainly includes a sheet feed section 12, a treatment liquid applying section 14, a treatment liquid-drying processing section 16, a drawing section 18, an ink-drying processing section 20, and a sheet discharge section 24. The respective sections will be described in detail below.

<Sheet Feed Section>

The sheet feed section 12 includes a sheet feed tray 30, a sucker device 32, a pair of sheet feed rollers 34, a feeder board 36, a front stopper 38, and a sheet feed cylinder 40. The feeder board 36 includes retainers 36A and a guide roller 36B.

The retainers 36A and the guide roller 36B are disposed on the transport surface of the feeder board 36 on which the sheet S is to be transported. The front stopper 38 is disposed between the feeder board 36 and the sheet feed cylinder 40.

The sheet feed cylinder 40 has the shape of a cylinder of which the longitudinal direction is a direction parallel to a rotating shaft 40B. The sheet feed cylinder 40 has a length that exceeds the entire length of the sheet S in the longitudinal direction. The direction of the rotating shaft 40B of the sheet feed cylinder 40 is a direction perpendicular to the plane of FIG. 1.

Here, the term of "parallel" in this specification includes "substantially parallel" where two directions cross each other but the same functional effect as the functional effect of "parallel" are obtained.

The term of "orthogonal" in this specification includes "substantially orthogonal" where the same functional effect as the functional effect of a case in which two directions cross each other at an angle of 90° are obtained in a case in which two directions cross each other at an angle exceeding 90° or a case in which two directions cross each other at an angle less than 90°.

The term of "the same" in this specification includes "substantially the same" where components serving as objects are different from each other but the same functional effect as the functional effect of "the same" is obtained.

The sheet feed cylinder 40 includes a gripper 40A. The gripper 40A includes a plurality of claws, a claw base, and a gripper shaft. The plurality of claws, the claw base, and the gripper shaft are not shown.

The plurality of claws of the gripper 40A are arranged along a direction parallel to the rotating shaft 40B of the sheet feed cylinder 40. Proximal end portions of the plurality of claws are supported by the gripper shaft so as to be capable of oscillating. The arrangement interval of the plurality of claws and the length of a region where the plurality of claws are arranged are determined depending on the size of the sheet S.

The claw base is a member of which the longitudinal direction is a direction parallel to the rotating shaft 40B of the sheet feed cylinder 40. In the longitudinal direction of the sheet feed cylinder 40, the length of the claw base is equal to or longer than a length where the plurality of claws are arranged. The claw base is disposed at a position facing distal end portions of the plurality of claws.

The sheet feed section 12 feeds sheets S, which are loaded on the sheet feed tray 30, to the treatment liquid applying section 14 one by one. The sheets S, which are loaded on the sheet feed tray 30, are sequentially lifted from the top one by one by the sucker device 32, and are fed to the pair of sheet feed rollers 34.

The sheet S, which is fed to the pair of sheet feed rollers 34, is placed on the feeder board 36 and is transported by the feeder board 36. The sheet S, which is transported by the feeder board 36, is pushed against the transport surface of the feeder board 36 by the retainers 36A and the guide roller 36B, so that the irregularity of the sheet S is corrected.

The front end of the sheet S, which is transported by the feeder board 36, comes into contact with the front stopper 38, so that the inclination of the sheet S is corrected. The sheet S, which is transported by the feeder board 36, is delivered to the sheet feed cylinder 40.

The front end portion of the sheet S, which is delivered to the sheet feed cylinder 40, is gripped by the gripper 40A of the sheet feed cylinder 40. The sheet S is transported along the outer peripheral surface of the sheet feed cylinder 40 in a case in which the sheet feed cylinder 40 is rotated. The sheet S, which is transported by the sheet feed cylinder 40, is delivered to the treatment liquid applying section 14.

<Treatment Liquid Applying Section>

The treatment liquid applying section 14 includes a treatment liquid cylinder 42 and a treatment liquid applying device 44. The treatment liquid cylinder 42 includes a gripper 42A. The same structure as the gripper 40A of the sheet feed cylinder 40 can be applied to the gripper 42A.

The treatment liquid cylinder 42 shown in FIG. 1 has a diameter double the diameter of the sheet feed cylinder 40. The treatment liquid cylinder 42 has a structure that fixes the sheet S to an outer peripheral surface 42C where the sheet S is to be supported. Examples of the structure that fixes the sheet S to the outer peripheral surface 42C of the treatment liquid cylinder 42 include a structure in which the outer peripheral surface 42C of the treatment liquid cylinder 42 is provided with a plurality of suction holes and negative pressure is applied to the plurality of suction holes.

The same structure as the sheet feed cylinder 40 can be applied to the treatment liquid cylinder 42 other than the above-mentioned structure. Reference numeral 42B denotes a rotating shaft of the treatment liquid cylinder 42.

A roller coating system can be applied to the treatment liquid applying device 44. A structure that includes a treatment liquid vessel, a measuring roller, and a coating roller can be employed as the treatment liquid applying device 44 to which the roller coating system is applied.

Treatment liquid, which is supplied from a treatment liquid tank through a treatment liquid supply system, is stored in the treatment liquid vessel. The measuring roller measures the treatment liquid that is stored in the treatment liquid vessel. The measuring roller transfers the measured treatment liquid to the coating roller. The coating roller coats a sheet S with the treatment liquid.

The structure of the treatment liquid applying device 44 described here is merely exemplary, and other systems may be applied to the treatment liquid applying device 44. Further, other structures may be applied to the treatment liquid applying device 44.

Examples of other systems, which can be applied to the treatment liquid applying device 44, include coating using blades, jetting using an ink jet system, spraying using a spray system, and the like.

In a case in which the treatment liquid cylinder 42 is rotated in a state in which the front end of the sheet S is gripped by the gripper 42A, the sheet S is transported along the outer peripheral surface of the treatment liquid cylinder 42. Treatment liquid is applied to the sheet S, which is transported along the outer peripheral surface of the treatment liquid cylinder 42, by the treatment liquid applying device 44. The sheet S to which the treatment liquid is applied is sent to the treatment liquid-drying processing section 16.

The treatment liquid, which is applied to the sheet S, has a function to aggregate color materials, which are contained in inks to be jetted to the sheet S in the drawing section 18 provided on a rear stage, or a function to insolubilize color materials of inks. Since inks are jetted to the sheet S after treatment liquid is applied to the sheet S, it is possible to form a high-quality image without causing landing interference even though a general-purpose sheet is used.

The term of "jetting" in this specification can be properly read as "jetting" or "image forming".

The sheet S to which treatment liquid is applied by the treatment liquid applying section 14 is delivered to the treatment liquid-drying processing section 16.

<Treatment Liquid-Drying Processing Section>

The treatment liquid-drying processing section 16 includes a treatment liquid-drying processing cylinder 46, sheet transport guides 48, and treatment liquid-drying processing units 50. The treatment liquid-drying processing cylinder 46 includes grippers 46A. The same structure as the gripper 40A of the sheet feed cylinder 40 can be applied to each of the grippers 46A.

The treatment liquid-drying processing cylinder 46 shown in FIG. 1 has a diameter double the diameter of the sheet feed cylinder 40. The grippers 46A are disposed at two positions on the treatment liquid-drying processing cylinder 46. The two positions where the grippers 46A are disposed are positions that are shifted from each other on an outer peripheral surface 46C of the treatment liquid-drying processing cylinder 46 by a half of the circumference of the treatment liquid-drying processing cylinder 46.

The same structure as the sheet feed cylinder 40 can be applied to the treatment liquid-drying processing cylinder 46 other than the above-mentioned structure. Reference numeral 46B denotes a rotating shaft of the treatment liquid-drying processing cylinder 46.

The sheet transport guides 48 are disposed at positions facing the outer peripheral surface 46C of the treatment liquid-drying processing cylinder 46. The sheet transport guides 48 are disposed on the lower side of the treatment liquid-drying processing cylinder 46.

The lower side in this specification is a side corresponding to a direction having a component corresponding to the direction of gravity. The upper side is a side corresponding to a direction having a component corresponding to a direction opposite to the direction of gravity.

The treatment liquid-drying processing units 50 are disposed in the treatment liquid-drying processing cylinder 46. Each of the treatment liquid-drying processing units 50 includes a blast part that sends air to the outside of the treatment liquid-drying processing cylinder 46 and a heating part that heats air. For the convenience of illustration, reference numerals of the blast part and the heating part will be omitted.

The front end of the sheet S, which is delivered to the treatment liquid-drying processing section 16 from the treatment liquid applying section 14, is gripped by the gripper 46A of the treatment liquid-drying processing cylinder 46.

In a state in which the surface of the sheet S coated with treatment liquid faces the outer peripheral surface 46C of the treatment liquid-drying processing cylinder 46, the surface of the sheet S opposite to the surface of the sheet S coated with treatment liquid is supported by the sheet transport guides 48. Then, as the treatment liquid-drying processing cylinder 46 is rotated, the sheet S is transported along the outer peripheral surface 46C of the treatment liquid-drying processing cylinder 46.

Heated air is sent to the sheet S, which is transported by the treatment liquid-drying processing cylinder 46 and is supported by the sheet transport guides 48, from the treatment liquid-drying processing unit 50, so that the sheet S is subjected to drying processing.

In a case in which the sheet S is subjected to drying processing, a solvent component contained in the treatment liquid applied to the sheet S is removed and a treatment liquid layer is formed on the surface of the sheet S to which the treatment liquid is applied. The sheet S, which is subjected to drying processing by the treatment liquid-drying processing section 16, is delivered to the drawing section 18.

<Drawing Section>

The drawing section 18 includes a drawing cylinder 52, a sheet pressing roller 54, a liquid jetting head 56C, a liquid jetting head 56M, a liquid jetting head 56Y, a liquid jetting head 56K, and an in-line sensor 58. The drawing cylinder 52 includes grippers 52A.

The grippers 52A are disposed in recessed portions that are provided on an outer peripheral surface 52C of the drawing cylinder 52. The same structure as the gripper 40A of the sheet feed cylinder 40 can be applied to each gripper 52A other than disposition.

The grippers 52A are disposed at two positions on the drawing cylinder 52 as in the case of the treatment liquid-drying processing cylinder 46. The same disposition as the disposition of the grippers on the treatment liquid-drying processing cylinder 46 can be applied as the disposition of the grippers 52A that are disposed at two positions.

Figure 3:
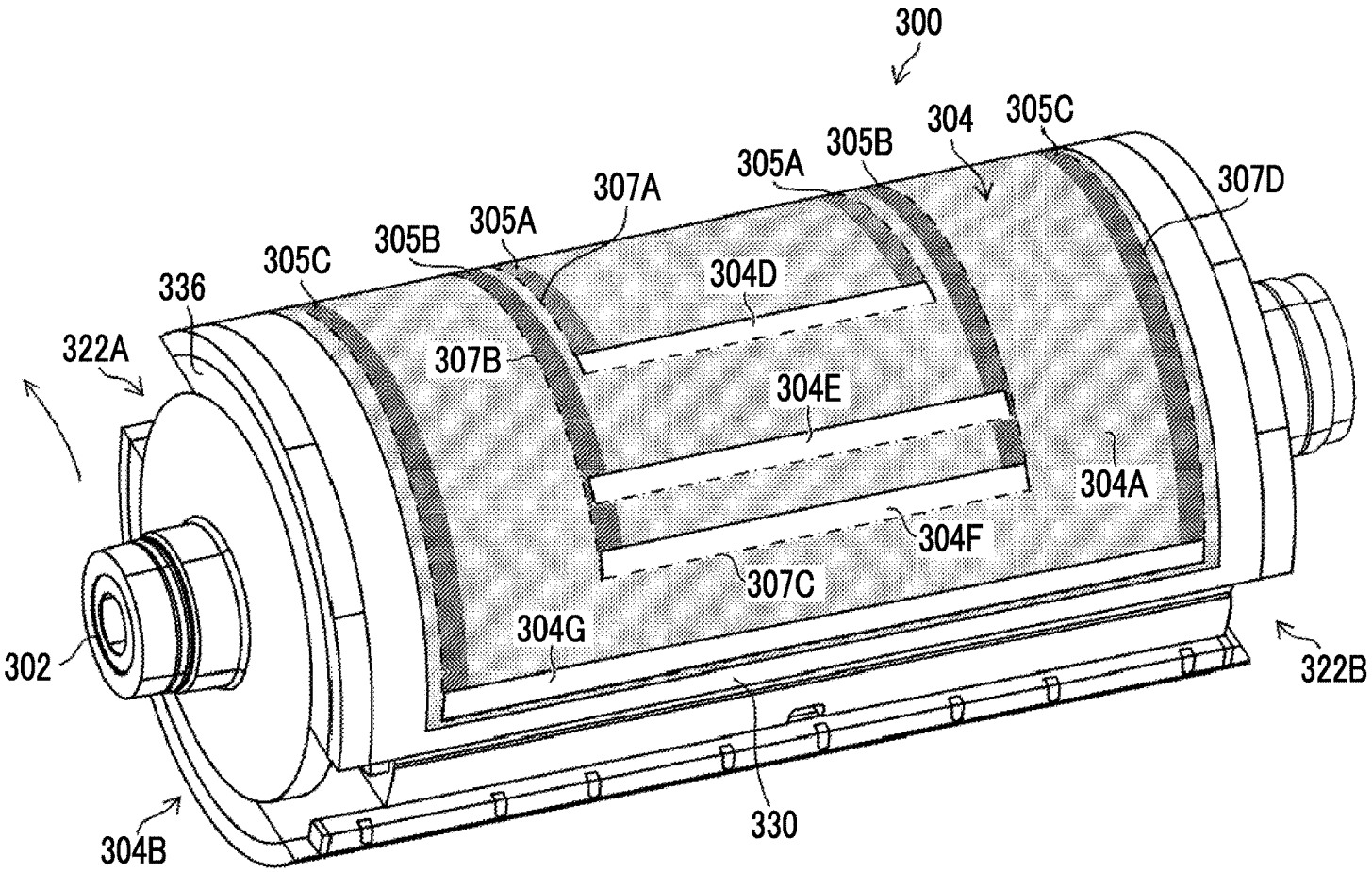
FIG. 3 is a perspective view of a transport drum.
Figure 5:
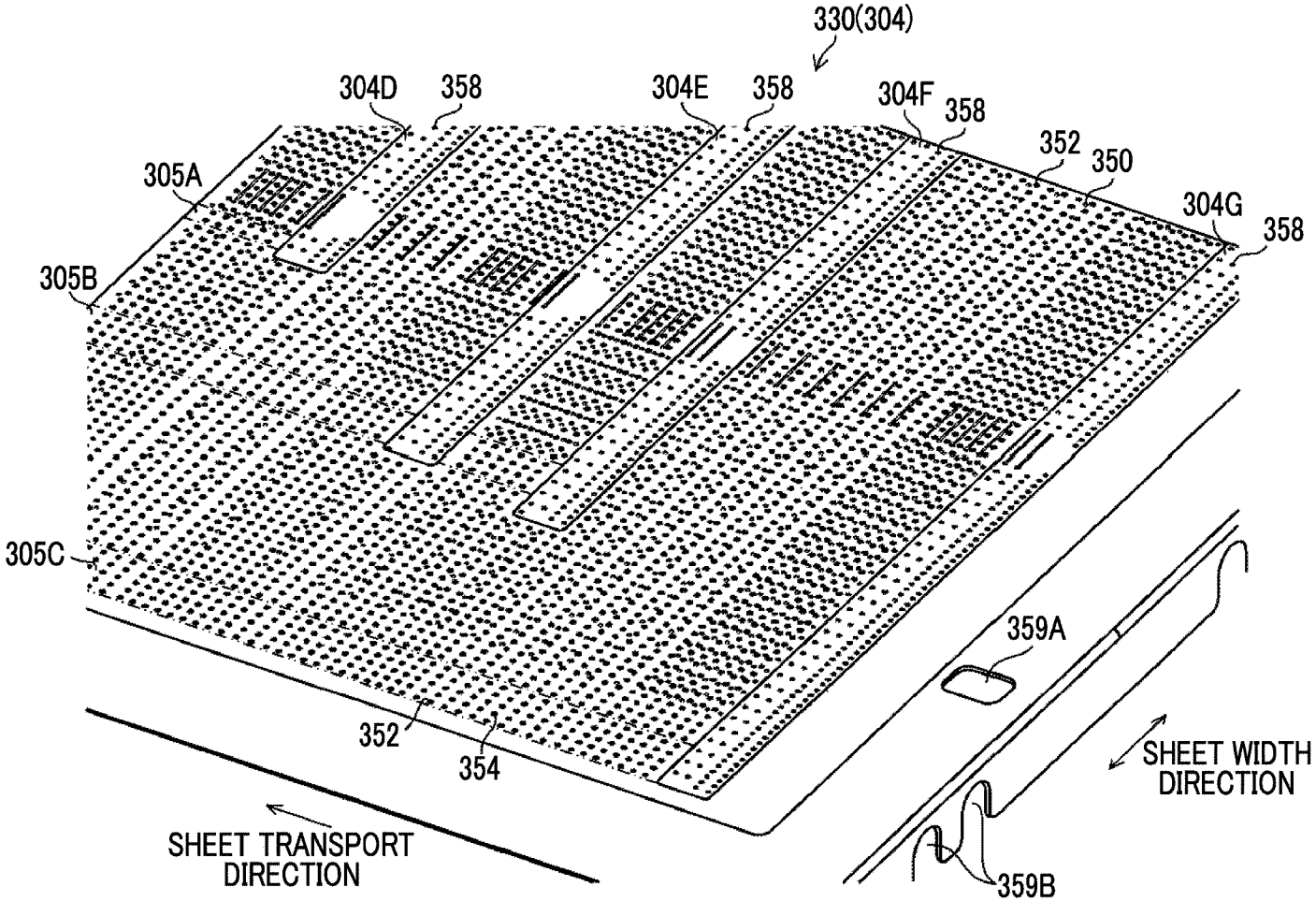
FIG. 5 is a diagram illustrating sealed portions according to a first embodiment.

Suction holes are arranged on the outer peripheral surface 52C of the drawing cylinder 52 where the sheet S is to be supported. The suction holes are arranged in medium support regions where the sheet S is to be sucked and supported. The suction holes are not shown in FIG. 1. The suction holes are shown in FIG. 5 and denoted by reference numeral 350. The medium support regions are not shown in FIG. 1. The medium support regions are shown in FIG. 3 and denoted by reference numerals 304A and 304B.

The same structure as the sheet feed cylinder 40 can be applied to the drawing cylinder 52 other than the above-mentioned structure. Reference numeral 52B denotes a rotating shaft of the drawing cylinder 52.

The sheet pressing roller 54 has a cylindrical shape. The longitudinal direction of the sheet pressing roller 54 is a direction parallel to the rotating shaft 52B of the drawing cylinder 52. The sheet pressing roller 54 has a length exceeding the entire length of the sheet S in the longitudinal direction.

The sheet pressing roller 54 is disposed on the downstream side of a delivery position of the sheet S and on the upstream side of the liquid jetting head 56C in the transport direction of the sheet S on the drawing cylinder 52. In the following description, the transport direction of the sheet S may be described as a sheet transport direction. The sheet transport direction corresponds to a medium transport direction.

Each of the liquid jetting heads 56C, 56M, 56Y, and 56K includes jetting elements that jet liquid by an ink jet system. The jetting element includes a nozzle opening. The jetting element may include a flow passage that communicates with the nozzle opening and a structure that generates jetting pressure. The liquid jetting head using an ink jet system includes a head that is called an ink jet head.

Here, an alphabet, which is added to the reference numeral of the liquid jetting head, represents a color. C represents cyan. M represents magenta. Y represents yellow K represents black.

The liquid jetting heads 56C, 56M, 56Y, and 56K are arranged on the upper side of the drawing cylinder 52. The liquid jetting heads 56C, 56M, 56Y, and 56K are arranged along the transport direction of the sheet S from the upstream side in the transport direction of the sheet S in the order of the liquid jetting heads 56C, 56M, 56Y, and 56K.

The in-line sensor 58 includes an imaging element, a peripheral circuit of the imaging element, and a light source. A solid-state imaging element, such as a CCD image sensor or a CMOS image sensor, can be applied as the imaging element. The imaging element, the peripheral circuit of the imaging element, and the light source are not shown.

CCD is an abbreviation for Charge Coupled. Device. CMOS is an abbreviation for Complementary Metal-Oxide Semiconductor. The in-line sensor 58 is disposed on the downstream side of the liquid jetting head 56K in the sheet transport direction.

The peripheral circuit of the imaging element includes a processing circuit for an output signal of the imaging element. Examples of the processing circuit include a filter circuit that removes noise components from the output signal of the imaging element, an amplifier circuit, a waveform shaping circuit, and the like. The filter circuit, the amplifier circuit, or the waveform shaping circuit is not shown.

The light source is disposed at a position where the light source can irradiate an object to be read by the in-line sensor with illumination light. An LED, a lamp, or the like can be applied as the light source. LED is an abbreviation for light emitting diode.

The front end of the sheet S, which is delivered to the drawing section 18 from the treatment liquid-drying processing section 16, is gripped by the gripper 52A of the drawing cylinder 52. The sheet S of which the front end is gripped by the gripper 52A of the drawing cylinder 52 is transported along the outer peripheral surface 52C of the drawing cylinder 52 as the drawing cylinder 52 is rotated.

In a case in which the sheet S passes through a position below the sheet pressing roller 54, the sheet S is pressed against the outer peripheral surface 52C of the drawing cylinder 52. An image is formed on the sheet S, which has passed through the position below the sheet pressing roller 54, directly below the liquid jetting heads 56C, 56M, 56Y, and 56K with color inks jetted from the respective liquid jetting heads 56C, 56M, 56Y, and 56K.

The image is read from the sheet S on which the image is formed by the liquid jetting heads 56C, 56M, 56Y, and 56K in a read region of the in-line sensor 58 by the in-line sensor 58.

The sheet S of which the image is read by the in-line sensor 58 by the in-line sensor 58 is delivered to the ink-drying processing section 20 from the drawing section 18. From the result of the reading of the image performed by the in-line sensor 58, it is possible to determine whether or not abnormality occurs in jetting.

The drawing section 18 shown in FIG. 1 is an aspect of an image forming section.

<Ink-Drying Processing Section>

The ink-drying processing section 20 includes a chain gripper 64, ink drying processing units 68, and a guide plate 72. The chain gripper 64 includes first sprockets 64A, second sprockets 64B, chains 64C, and a plurality of grippers 64D.

The chain gripper 64 has a structure in which a pair of endless chains 64C is wound around a pair of first sprockets 64A and a pair of second sprockets 64B. Only one of the pair of first sprockets 64A, only one of the pair of second sprockets 64B, and only one of the pair of chains 64C are shown in FIG. 1.

The chain gripper 64 has a structure in which the plurality of grippers 64D are arranged between the pair of chains 64C.

Further, the chain gripper 64 has a structure in which the plurality of grippers 64D are arranged at a plurality of positions in the medium transport direction. Only one-side grippers 64D among the plurality of grippers 64D, which are arranged between the pair of chains 64C, are shown in FIG. 1.

The chain gripper 64 shown in FIG. 1 includes a horizontal transport region where the sheet S is transported along a horizontal direction and an inclined transport region where the sheet S is transported obliquely upward.

The ink drying processing units 68 are arranged above a transport path of the sheet S in the chain gripper 64. Examples of the structure of the ink drying processing unit 68 include a structure including a heat source, such as a halogen heater or an infrared heater. Other examples of the structure of the ink drying processing unit 68 include a structure that includes a fan blowing air, which is heated by a heat source, to the sheet S. The ink drying processing unit 68 can have a structure that includes a heat source and a fan.

The guide plate 72 is not shown in detail, but a plate-like member may be applied as the guide plate 72. The guide plate 72 has a length exceeding the entire length of the sheet S in a direction orthogonal to the sheet transport direction.

The guide plate 72 is disposed along the transport path of the sheet S in the horizontal transport region of the chain gripper 64. The guide plate 72 is disposed on the lower side of the transport path of the sheet S in the chain gripper 64. The guide plate 72 has a length corresponding to the length of processing regions of the ink drying processing units 68 in the sheet transport direction.

The length corresponding to the length of the processing regions of the ink drying processing units 68 is the length of the guide plate 72 that allows the sheet S to be supported by the guide plate 72 during the processing of the ink drying processing units 68.

For example, an aspect in which the length of the processing regions of the ink drying processing units 68 and the length of the guide plate 72 are equal to each other in the sheet transport direction is provided as an example. The guide plate 72 may have a function to suck and support the sheet S.

The front end of the sheet S, which is delivered to the ink-drying processing section 20 from the drawing section 18, is gripped by the gripper 64D. In a case in which at least one of the first and second sprockets 64A and 64B is rotated clockwise in FIG. 1 to make the chains 64C to travel, the sheet S is transported along the travel path of the chains 64C.

In a case in which the sheet S passes through the processing regions of the ink drying processing units 68, the sheet S is subjected to ink drying processing by the ink drying processing units 68.

The sheet S, which is subjected to ink drying processing by the ink drying processing units 68, is transported by the chain gripper 64 and is sent to the sheet discharge section 24.

The chain gripper 64 shown in FIG. 1 transports the sheet S obliquely upward to the left in FIG. 1 on the downstream side of the ink drying processing units 68 in the sheet transport direction. A guide plate 73 is disposed on the transport path in the inclined transport region where the sheet S is transported obliquely upward to the left in FIG. 1.

The same member as the guide plate 72 can be applied as the guide plate 73. The description of the structure and function of the guide plate 73 will be omitted.

<Sheet Discharge Section>

The sheet discharge section 24 includes a sheet discharge tray 76. The chain gripper 64 is applied to the transport of the sheet S in the sheet discharge section 24.

The sheet discharge tray 76 is disposed on the lower side of the transport path of the sheet S in the chain gripper 64. The sheet discharge tray 76 can include a raising /lowering mechanism (not shown). The sheet discharge tray 76 is raised/lowered according to an increase/decrease in the number of sheets S to be loaded, so that the height of the uppermost sheet S can be maintained constant.

The sheet discharge section 24 collects the sheet S that has been subjected to a series of processing for forming an image. In a case in which the sheet S reaches the position of the sheet discharge tray 76, the gripper 64D releases the grip of the sheet S. The sheet S is loaded on the sheet discharge tray 76.

The ink jet recording apparatus 10, which includes the treatment liquid applying section 14 and the treatment liquid-drying processing section 16, is shown in FIG. 1, but the treatment liquid applying section 14 and the treatment liquid-drying processing section 16 may be omitted.

Further, the chain gripper 64 is exemplified in FIG. 1 as a structure for transporting the sheet S on which an image has been drawn, but other structures, such as a structure for transporting the sheet S by a belt or a structure for transporting the sheet S by a transport drum, can also be applied as the structure for transporting the sheet S on which an image has been drawn.

[Description of Control system]

Figure 2:
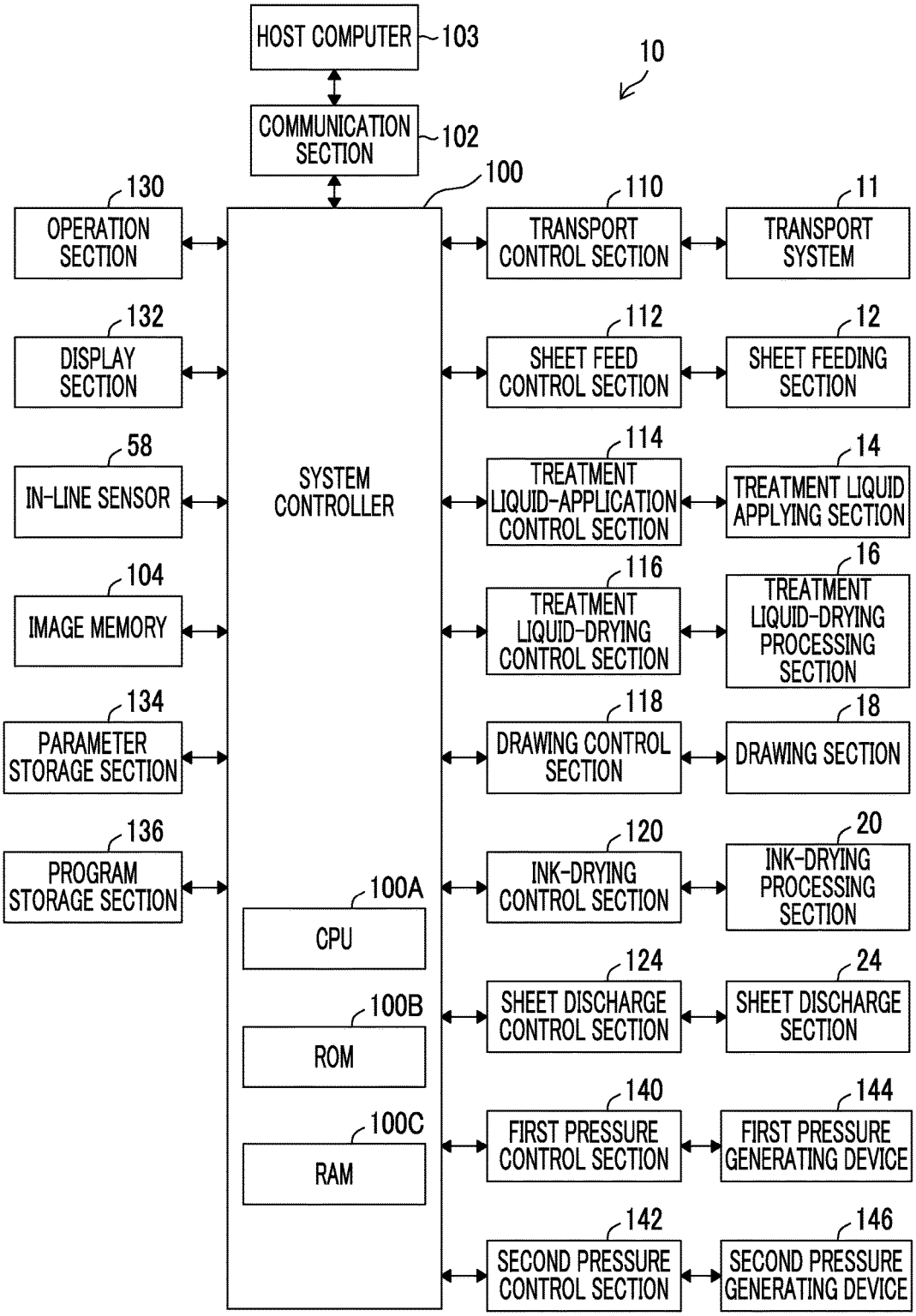
FIG. 2 is a block diagram showing the schematic configuration of a control system of the ink jet recording apparatus.

FIG. 2 is a block diagram showing the schematic configuration of a control system of the ink jet recording apparatus 10. As shown in FIG. 2, the ink jet recording apparatus 10 includes a system controller 100. The system controller 100 includes a CPU 100A, a ROM 100B, and a RAM 100C.

The ROM 100B and the RAM 1000 shown in FIG. 2 may be provided outside the CPU. CPU is an abbreviation for Central Processing Unit. ROM is an abbreviation for Read Only Memory. RAM is an abbreviation for Random Access Memory.

The system controller 100 functions as an overall control section that generally controls the respective sections of the ink jet recording apparatus 10. Further, the system controller 100 functions as an arithmetic section that performs various kinds of arithmetic processing.

Furthermore, the system controller 100 functions as a memory controller that controls the reading of data of memories, such as the ROM 100B and the RAM 100C, and the writing of data.

The ink jet recording apparatus 10 includes a communication section 102, an image memory 104, a transport control section 110, a sheet feed control section 112, a treatment liquid-application control section 114, a treatment liquid-drying control section 116, a drawing control section 118, an ink-drying control section 120, and a sheet discharge control section 124.

The communication section 102 includes a communication interface (not shown). The communication section 102 transmits and receives data to and from a host computer 103 connected to the communication interface.

The image memory 104 functions as a temporary storage section for various kinds of data including image data. Data is read from and written and in the image memory 104 through the system controller 100. Image data, which is taken from the host computer 103 through the communication section 102, is temporarily stored in the image memory 104.

The transport control section 110 controls the operation of a transport system 11 for the sheet S of the ink jet recording apparatus 10. The transport system 11 shown in FIG. 2 includes the treatment liquid cylinder 42, the treatment liquid-drying processing cylinder 46, the drawing cylinder 52, and the chain gripper 64 shown in FIG. 1.

The transport system 11 is an aspect of a transport section. At least the drawing cylinder 52 is a component of the transport section.

The sheet feed control section 112 shown in FIG. 2 allows the sheet feed section 12 to be operated according to a command sent from the system controller 100. The sheet feed control section 112 controls an operation for starting feeding the sheet S, an operation for stopping feeding the sheet S, and the like.

The treatment liquid-application control section 114 allows the treatment liquid applying section 14 to be operated according to a command sent from the system controller 100. The treatment liquid-application control section 114 controls the amount of treatment liquid to be applied, a treatment liquid-application timing, and the like.

The treatment liquid-drying control section 116 allows the treatment liquid-drying processing section 16 to be operated according to a command sent from the system controller 100. The treatment liquid-drying control section 116 controls drying temperature, the flow rate of dry gas, the injection timing of dry gas, and the like.

The drawing control section 118 controls the operation of the drawing section 18 according to a command sent from the system controller 100.

The drawing control section 118 includes an image processing unit, a waveform generation unit, a waveform storage unit, and a drive circuit. The image processing unit, the waveform generation unit, the waveform storage unit, and the drive circuit are not shown.

The image processing unit generates dot data from input image data. The waveform generation unit generates the waveform of a drive voltage. The waveform of a drive voltage is stored in the waveform storage unit. The drive circuit generates a drive voltage that has a drive waveform corresponding to the dot data. The drive circuit supplies the drive voltage to the liquid jetting heads.

In the image processing unit, the input image data is subjected to color separation processing for separating a color into the respective colors of RGB, color conversion processing for converting RGB into CMYK, correction processing, such as gamma correction and unevenness correction, and halftoning for converting the gradation value of each pixel corresponding to each color into a gradation value smaller than an original gradation value.

Examples of the input image data include raster data that is represented by a digital value in the range of 0 to 255. The dot data, which is obtained as the result of halftoning, may be a binary value, or may be a multi-level value that is a ternary value or more and is smaller than a gradation value before the halftoning.

A jetting timing and the amount of ink to be jetted at the position of each pixel are determined on the basis of the dot data that is generated through the processing performed by the image processing unit; a drive voltage corresponding to the jetting timing and the amount of ink to be jetted at the position of each pixel and a control signal for determining the jetting timing at each pixel are generated; and the drive voltage is supplied to the liquid jetting head, so that and a dot is recorded with ink jetted from the liquid jetting head.

The drawing control section 118 includes a correction processing unit (not shown). The correction processing unit performs processing for correcting an abnormal nozzle. In a case in which the processing for correcting an abnormal nozzle is performed, deterioration in image quality, which is caused by the generation of the abnormal nozzle, is suppressed.

The ink-drying control section 120 allows the ink-drying processing section 20 to be operated according to a command sent from the system controller 100. The ink-drying control section 120 controls the temperature of dry gas, the flow rate of dry gas, the injection timing of dry gas, or the like.

The sheet discharge control section 124 allows the sheet discharge section 24 to be operated according to a command sent from the system controller 100. In a case in which the sheet discharge tray 76 includes a raising/lowering mechanism, the sheet discharge control section 124 controls the operation of the raising/lowering mechanism according to an increase/decrease in the number of sheets S.

The ink jet recording apparatus 10 includes an operation section 130, a display section 132, a parameter storage section 134, and a program storage section 136.

The operation section 130 includes an operation member, such as an operation button, a keyboard, or a touch panel. The operation section 130 may include a plurality of kinds of operation members. The operation member is not shown. Information, which is input through the operation section 130, is sent to the system controller 100. The system controller 100 performs various kinds of processing according to the information that is sent from the operation section 130.

The display section 132 includes a display device, such as a liquid crystal panel, and a display driver. The display device and the display driver are not shown. The display section 132 allows the display device to display various kinds of configuration information of the apparatus, or various kinds of information, such as information on abnormality, according to a command sent from the system controller 100.

Various parameters, which are used in the ink jet recording apparatus 10, are stored in the parameter storage section 134. Various parameters, which are stored in the parameter storage section 134, are read through the system controller 100, and are set to the respective sections of the apparatus.

Programs, which are used in the respective sections of the ink jet recording apparatus 10, are stored in the program storage section 136. Various programs, which are stored in the program storage section 136, are read through the system controller 100, and are performed in the respective sections of the apparatus.

The ink jet recording apparatus 10 includes a first pressure control section 140 and a second pressure control section 142.

The first pressure control section 140 controls the operation of a first pressure generating device 144 according to a command sent from the system controller 100. Examples of the first pressure generating device include a pump. The second pressure control section 142 controls the operation of a second pressure generating device 146 according to a command sent from the system controller 100. Examples of the second pressure generating device include a pump.

The first pressure generating device 144 (or the second pressure generating device 146) can double as the second pressure generating device 146 (or the first pressure generating device 144). In an aspect in which the first pressure generating device 144 (or the second pressure generating device 146) is made to double as the second pressure generating device 146 (or the first pressure generating device 144), the first pressure control section 140 (or the second pressure control section 142) doubles as the second pressure control section 142 (or the first pressure control section 140).

The first pressure generating device 144 is a component of a first pressure generating section. An aspect that includes the first pressure generating device 144, a first pipe (not shown), and a first flow passage not shown in FIG. 2 can be applied to the first pressure generating section.

The first pipe is a pipe that connects the first pressure generating device 144 to the first flow passage not shown in FIG. 1 provided in the drawing cylinder 52 shown in FIG. 1.

The first flow passage is a flow passage that is provided in the drawing cylinder 52 and is to be connected to suction holes 350 to be described later. First suction holes correspond to the suction holes 350.

The second pressure generating device 146 is a component of a second pressure generating section. An aspect that includes the second pressure generating device 146, a second pipe (not shown), and a second flow passage not shown in FIG. 2 can be applied to the second pressure generating section.

The second pipe is a pipe that connects the second pressure generating device 146 to the second flow passage not shown in FIG. 1 provided in the drawing cylinder 52 shown in FIG. 1.

The second flow passage is a flow passage that is provided in the drawing cylinder 52 and is to be connected to protrusion-suction holes 356 to be described later. Second suction holes correspond to the protrusion-suction holes 356.

In FIG. 2, the respective sections are listed for every function. The respective sections shown in FIG. 2 can be properly integrated, can be properly separated, can properly double as the sections, or can be properly omitted. Further, the respective sections shown in FIG. 2 can be formed of a proper combination of hardware and software.

[Description of Structure of Drawing Cylinder]

Next, the structure of the drawing cylinder 52 shown in FIG. 1 will be described in detail. In the following description, a transport drum corresponding to the drawing cylinder 52 of FIG. 1 will be denoted by reference numeral 300. An arrow shown in FIG. 3 indicates the sheet transport direction.

FIG. 3 is a perspective view of the transport drum. As shown in FIG. 3, the transport drum 300 has a cylindrical shape. The transport drum 300 includes a rotating shaft 302 extending along a direction parallel to the central axis of the cylindrical shape. The transport drum 300 is rotatably supported by the rotating shaft 302. The rotating shaft 302 is supported by bearings (not shown). The rotating shaft 302 shown in FIG. 3 has the same structure as the rotating shaft 52B shown in FIG. 1.

The length of the transport drum 300 is set to be equal to or longer than the length of a sheet S, which has the maximum size, in the direction of the rotating shaft. The sheet S is not shown in FIG. 3.

The rotating shaft 302 is supported by a frame (not shown) of the apparatus. The rotating shaft 302 is connected to a drive unit (not shown). The drive unit (not shown) includes a motor and connecting members, such as a gear and a shaft, which connect a shaft of the motor to the rotating shaft 302.

In a case in which the shaft of the motor is rotated and operates the drive unit, the transport drum 300 is rotated about the rotating shaft 302.

The transport drum 300 includes a support surface 304 where a sheet S is supported. The support surface 304 is divided into two support surfaces by a recessed portion 322A and a recessed portion 322B. One of the two divided support surfaces of the support surface 304 is provided with a first support region 304A. The other (not shown) of the two divided support surfaces of the support surface 304 is provided with a second support region 304B.

Grippers (not shown) are disposed in the recessed portions 322A and 322B. The grippers (not shown) correspond to the grippers 52A of FIG. 1. The gripper disposed in the recessed portion 322A and the gripper disposed in the recessed portion 322B grip the front ends of sheets S.

The sheet S of which the front end is gripped by the gripper disposed in the recessed portion 322A is supported by the first support region 304A. The sheet S of which the front end is gripped by the gripper disposed in the recessed portion 322B is supported by the second support region 304B.

The first and second support regions 304A and 304B have the same structure. Here, the structure of the first support region 304A will be described and the description of the structure of the second support region 304B will be omitted.

A plurality of suction holes are arranged in the first support region 304A shown in FIG. 3. The plurality of suction holes are not shown in FIG. 3. The plurality of suction holes not shown in FIG. 3 are shown in FIG. 5 and denoted by reference numeral 350.

A plurality of first protrusions and a plurality of second protrusions are arranged in the first support region 304A. The plurality of first protrusions and the plurality of second protrusions are not shown in FIG. 3. The plurality of first protrusions are shown in FIG. 5 and denoted by reference numeral 352. The plurality of second protrusions are shown in FIG. 5 and denoted by reference numeral 354.

Each of the first and second protrusions has a certain height from a surface where openings of the suction holes are formed. The heights of the first and second protrusions are determined from an effect of preventing the deformation of a sheet S.

Here, the support surface 304 of the transport drum 300 is the surface where the openings of the suction holes are formed, and is a surface that forms the proximal ends of the first protrusions and the proximal ends of the second protrusions. The details of the suction holes, the first protrusions, and the second protrusions will be described later.

First sealed portions 305A, second sealed portions 305B, and third sealed portions 305C are arranged in the first support region 304A shown in FIG. 3. The first sealed portions 305A are disposed at positions where both end portions of a sheet S having a first size in the width direction of the sheet S are supported. A one-dot chain line denoted by reference numeral 307A indicates a region where the sheet S having the first size is supported.

The second sealed portions 305B are disposed at positions where both end portions of a sheet S having a second size in the width direction of the sheet S are supported and positions where a sheet S having a third size is supported. A one-dot chain line denoted by reference numeral 307B indicates a region where the sheet S having the second size is supported. A one-dot chain line denoted by reference numeral 307C indicates a region where the sheet S having the third size is supported.

The third sealed portions 305C are disposed at positions where both end portions of a sheet S having a fourth size in the width direction of the sheet S are supported. A one-dot chain line denoted by reference numeral 307D indicates a region where the sheet S having the fourth size is supported.

Here, an end portion of a sheet S is a region of a sheet S that has a certain length from an end of the sheet S. The length of an end portion of a sheet S in the width direction of the sheet S is determined in terms of preventing the floating of the end portions of the sheet S in the width direction of the sheet S.

In the following description, the first sealed portions 305A, the second sealed portions 305B, and the third sealed portions 305C may be generically described as sealed portions. Further, the width direction of the sheet S may be described as a sheet width direction. The width direction of the sheet S and the sheet width direction correspond to a medium width direction.

The first support region 304A shown in FIG. 3 includes a first sheet-rear-end support region 304D, a second sheet-rear-end support region 304E, a third sheet-rear-end support region 304F, and a fourth sheet-rear-end support region 304G.

The first sheet-rear-end support region 304D is disposed at a position where the rear end portion of the sheet S having the first size is supported. The second sheet-rear-end support region 304E is disposed at a position where the rear end portion of the sheet S having the second size is supported.

The third sheet-rear-end support region 304F is disposed at a position where the rear end portion of the sheet S having the third size is supported. The fourth sheet-rear-end support region 304G is disposed at a position where the rear end portion of the sheet S having the fourth size is supported. The rear end portion of a sheet S is an upstream end portion of the sheet in the sheet transport direction in a case in which the sheet S is transported.

Each of the first sheet-rear-end support region 304D, the second sheet-rear-end support region 304E, the third sheet-rear-end support region 304F, and the fourth sheet-rear-end support region 304G has a certain height from the surface where the openings of the suction holes are formed. It is preferable that the heights of the first sheet-rear-end support region 304D, the second sheet-rear-end support region 304E, the third sheet-rear-end support region 304F, and the fourth sheet-rear-end support region 304G are equal to the height of the first protrusion and the height of the second protrusion.

A plurality of rear-end-suction holes not shown in FIG. 3 are arranged in the first sheet-rear-end support region 304D, the second sheet-rear-end support region 304E, the third sheet-rear-end support region 304F, and the fourth sheet-rear-end support region 304G. The rear-end-suction holes are shown in FIG. 5 and denoted by reference numeral 358.

The length of the rear end portion of a sheet S from the rear end of the sheet S is determined in terms of preventing the floating of the rear end portion of the sheet S.

Although not shown, the first support region 304A is provided with unopen regions. The unopen region is a region where the suction holes and the rear-end-suction holes are not formed. The positions of the unopen regions correspond to the positions of transport drum-suction grooves arranged on a body part 336 in a state in which suction sheets 330 are wound on the surface of the body part 336. The transport drum-suction grooves are shown in FIG. 4 and denoted by reference numeral 332.

Figure 4:
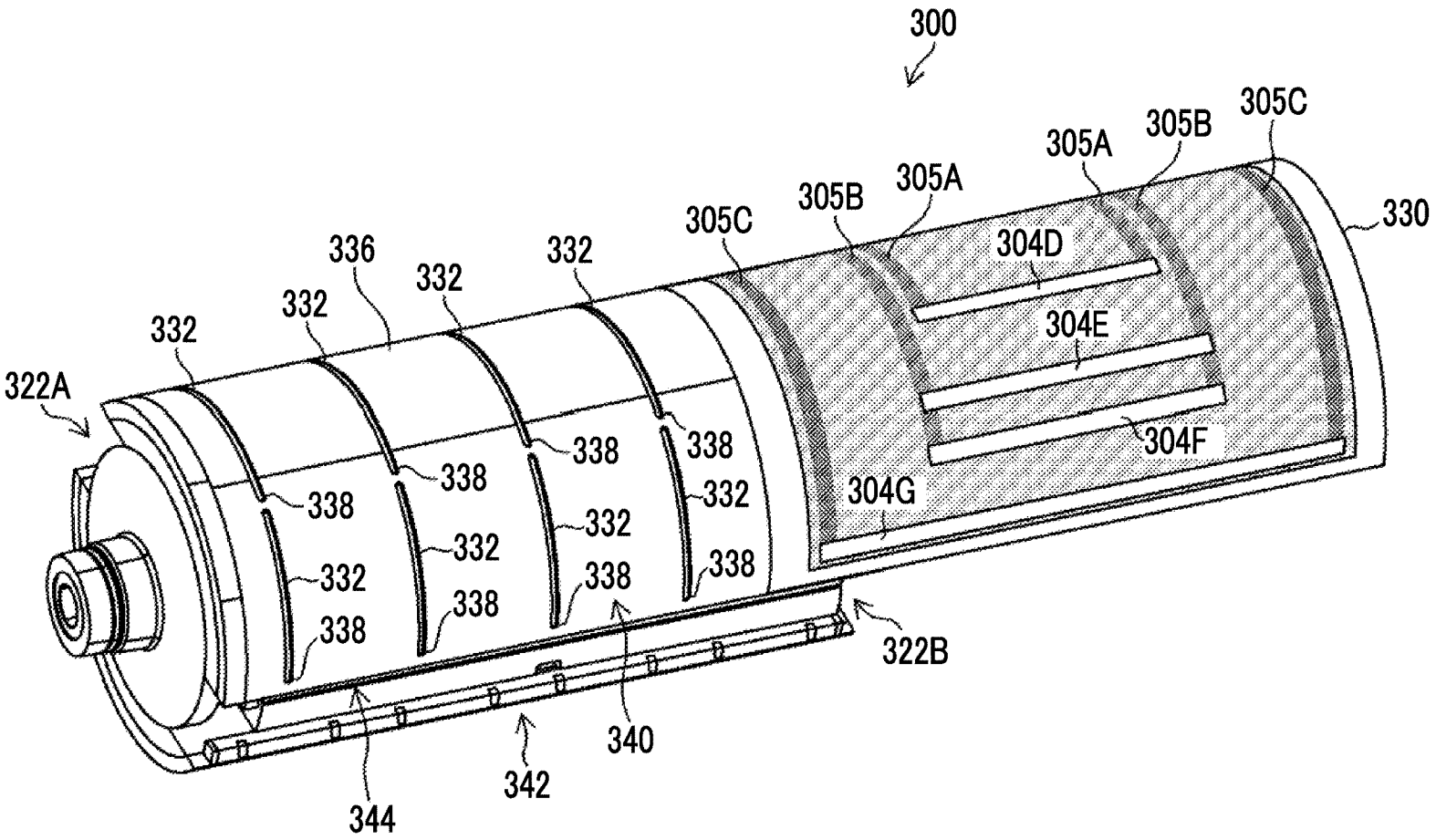
FIG. 4 is an exploded perspective view of the transport drum.

FIG. 4 is an exploded perspective view of the transport drum. In FIG. 4, only one of two suction sheets 330 is shown in FIG. 4 and the other suction sheet is not shown.

As shown in FIG. 4, the transport drum 300 has a structure in which the suction sheets 330 are wound on the surface 340 of the body part 336.

The surface 340 of the body part 336 is provided with the plurality of transport drum-suction grooves 332. The plurality of transport drum-suction grooves 332 are arranged along the direction of the rotating shaft 302 of the transport drum 300. Each of the plurality of transport drum-suction grooves 332 is adapted to extend in a direction parallel to the circumferential direction of the transport drum 300.

Each of the transport drum-suction grooves 332 shown in FIG. 4 is adapted to be divided into two pieces in the circumferential direction of the body part 336. A transport drum-suction hole 338 is disposed in each of the plurality of transport drum-suction grooves 332 shown in FIG. 4.

The transport drum-suction grooves 332 are disposed at positions where the transport drum-suction grooves 332 are closed by the unopen regions (not shown) in a state in which the suction sheets 330 are wound on the surface 340 of the body part 336 as described above.

Figure 9:
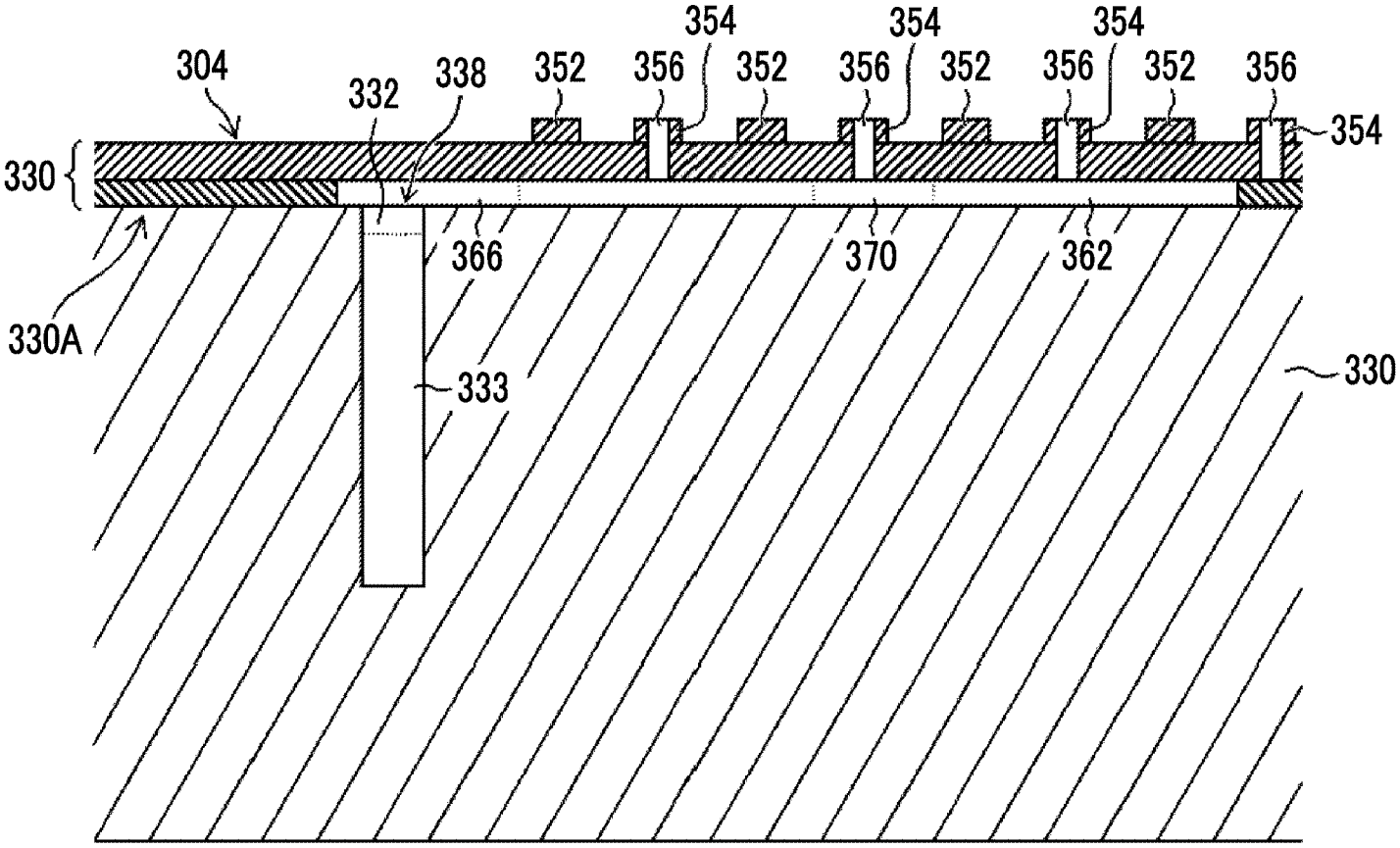
FIG. 9 is a cross-sectional view taken along line 9-9 of FIG. 8.

The transport drum-suction hole 338 is formed in each transport drum-suction groove 332. The transport drum-suction holes 338 are adapted to extend to the inside of the body part 336. The transport drum-suction holes 338 communicate with a suction flow passage, which is not shown in FIG. 4, in the body part 336. The suction flow passage is shown in FIG. 9 and denoted by reference numeral 333. The transport drum-suction grooves 332, the transport drum-suction holes 338, and the suction flow passage (not shown) are components of the first flow passage.

The body part 336 shown in FIG. 4 is provided with suction sheet-front-end fixing parts 342. The suction sheet-front-end fixing parts 342 shown in FIG. 4 are grooves, and the front end portions of the suction sheets 330 are inserted into the suction sheet-front-end fixing parts 342. The front ends of the suction sheets 330 are inserted into the suction sheet-front-end fixing parts 342, so that the front ends of the suction sheets 330 are fixed to the body part 336.

The suction sheet-front-end fixing parts 342 are provided in the recessed portions 322A and 322B, respectively. The suction sheet-front-end fixing part provided in the recessed portion 322A is not shown.

The body part 336 shown in FIG. 4 is provided with suction sheet-rear-end fixing parts 344. The rear ends of the suction sheets 330, which are wound on the surface 340 of the body part 336, are fixed to the body part 336 by the suction sheet-rear-end fixing parts 344. The suction sheet-rear-end fixing parts 344 are provided in the recessed portions 322A and 322B, respectively. The suction sheet-rear-end fixing part 344 provided in the recessed portion 322A is not shown.

Each suction sheet-rear-end fixing part 344 can employ an aspect in which each suction sheet-rear-end fixing part 344 includes a pulling portion for pulling the suction sheet 330, of which the front end is fixed to the suction sheet-front-end fixing part 342, toward the rear end of the suction sheet, a positioning portion for positioning the body part 336 and the suction sheet 330 in a state in which the suction sheet 330 is pulled toward the rear end thereof, and a fixing portion for fixing the rear end of the suction sheet 330.

The suction sheet-front-end fixing parts 342 and the suction sheet-rear-end fixing parts 344 shown in FIG. 4 are components of an attachment/detachment unit that attaches and detaches the suction sheets 330 to and from the body part 336.

[Detailed Description of Sealed Portion According to First Embodiment]

Figure 6:
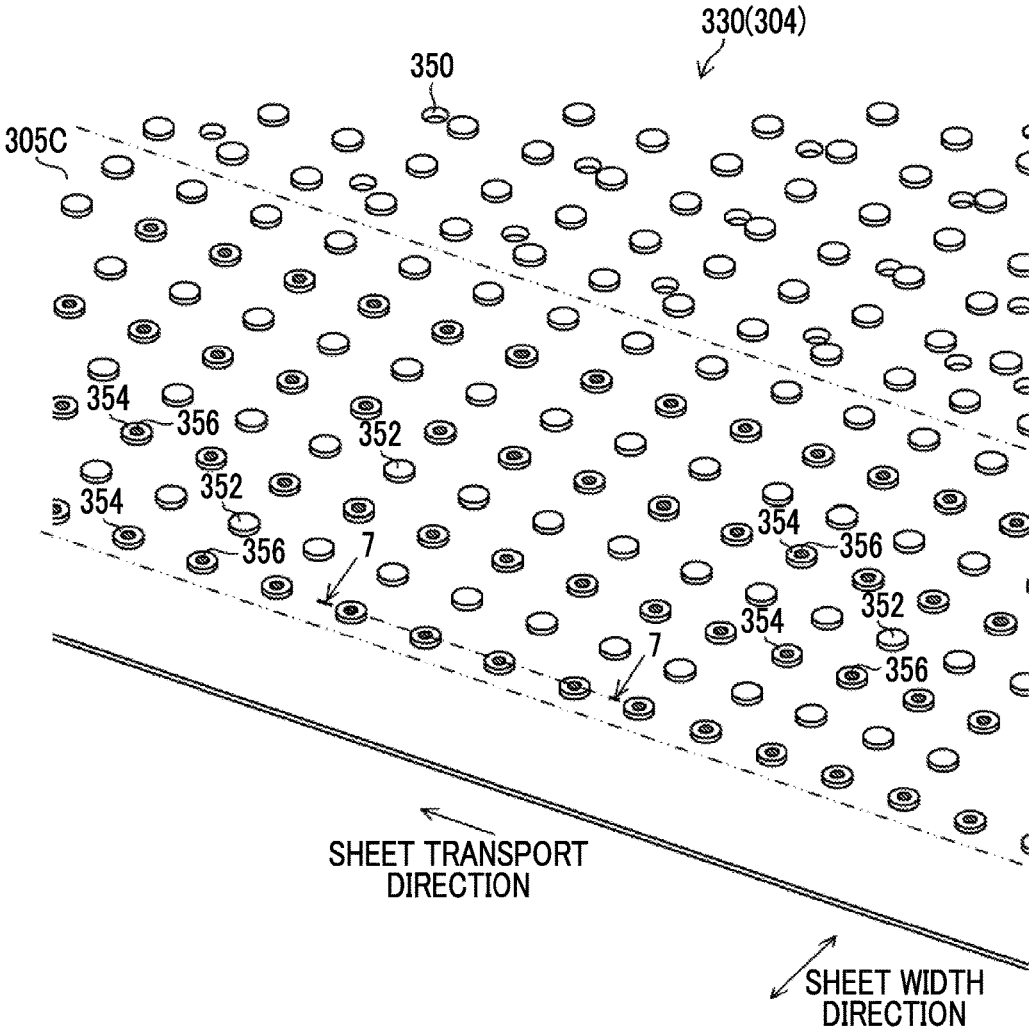
FIG. 6 is an enlarged view of a part of FIG. 5.

Next, sealed portions according to a first embodiment will be described in detail. FIG. 5 is a diagram illustrating sealed portions according to the first embodiment, and is an enlarged view of a part of the suction sheet 330. FIG. 6 is an enlarged view of a part of FIG. 5, and enlarges a part of the third sealed portions 305C.

The suction holes 350, the first protrusions 352, and the second protrusions 354 of FIGS. 5 and 6 are simplified and shown so that the arrangement relationships of the suction holes 350, the first protrusions 352, and the second protrusions 354 are grasped.

As shown in FIGS. 5 and 6, the third sealed portions 305C are provided with first protrusions 352 and second protrusions 354. The suction holes 350 are not arranged on the third sealed portions 305C. The second protrusions 354 are provided only on the first sealed portions 305A, the second sealed portions 305B, and the third sealed portions 305C.

The diameter of the first protrusion 352 can be set to be equal to the diameter of the second protrusion. For example, the diameter of the first protrusion 352 and the diameter of the second protrusion 354 can be set to 0.5 mm. The diameter of the second protrusion 354 may be set to be different from the diameter of the first protrusion 352.

An aspect in which the second protrusions 354 are arranged on the outermost side of the third sealed portion 305C in the sheet width direction and the first and second protrusions 352 and 354 are alternately arranged is shown in this embodiment. As long as the function of the second protrusions 354 is realized, the first and second protrusions 352 and 354 may be arranged in any arrangement. The same applies to the arrangement of the first protrusions 352.

Further, an aspect in which both the first protrusions 352 and the second protrusions 354 are arranged on the third sealed portions 305C is exemplified. At least the second protrusions 354 have only to be arranged on the third sealed portions 305C. The same applies to the first and second sealed portions 305A and 305B.

A positioning hole 359A shown in FIG. 5 is used to position the suction sheet 330 relative to the body part 336. Further, notched portions 359B shown in FIG. 5 are notches through which screw portions of screws for fixing the suction sheet 330 to the body part 336 pass.

The positioning hole 359A and the notched portions 359B shown in FIG. 5 are an aspect of components of the attachment/detachment unit that attaches and detaches the suction sheets 330 to and from the body part 336.

As shown in FIG. 6, a protrusion-suction hole 356 is formed at the distal end of each second protrusion 354. The diameter of the protrusion-suction hole 356 is a diameter allowing the flow rate of air, which can suppress the floating of the end portions of the sheet S, to be ensured, and may be smaller than the diameter of the distal end of the second protrusion 354.

Figure 7:
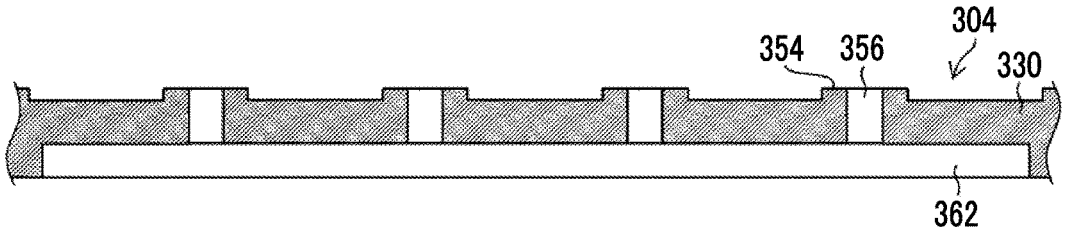
FIG. 7 is a cross-sectional view taken along line 7-7 of FIG. 6.

FIG. 7 is a cross-sectional view taken along line 7-7 of FIG. 6. As shown in FIG. 7, the protrusion-suction holes 356 are adapted to be perforated in the suction sheet 330. The protrusion-suction holes 356 communicate with the suction flow passage, which is provided in the body part 336, through a suction groove 362 that is formed on the back surface of the suction sheet 330, the transport drum-suction grooves 332 that are not shown in FIG. 7 and are connected to the suction groove 362, and the transport drum-suction holes 338 that are not shown in FIG. 7. The suction groove 362, the transport drum-suction grooves 332 that are not shown in FIG. 7, the transport drum-suction holes 338 that are not shown in FIG. 7, and the suction flow passage (not shown) are components of a second flow passage.

That is, the protrusion-suction holes 356 can generate suction pressure as in the suction holes 350. In regard to the same suction pressure mentioned here, suction pressure in a case in which the sheet S is sucked by the protrusion-suction holes 356 and is supported is substantially the same as suction pressure in a case in which the sheet S is sucked by the suction holes 350 and is supported. The protrusion-suction holes 356 and the suction holes 350 can have the same functional effect in terms of sucking and supporting the sheet S.

The structure of the flow passage, which communicates with the suction holes 350 described with reference to FIGS. 5 to 7, is merely exemplary, and other structures of the flow passage can be properly employed.

An aspect in which the second protrusions 354 are uniformly arranged on the entire third sealed portions 305C is exemplified in FIG. 6, but the second protrusions 354 have only to be arranged on the third sealed portions 305C at positions where at least the ends of a sheet S in the sheet width direction are supported. The same applies to the first and second sealed portions 305A and 305B shown in FIG. 5.

For examples, the second protrusions 354 may be not uniformly arranged as in a case in which the second protrusions 354 are arranged to be concentrated on the outside of the third sealed portions 305C in the sheet width direction. Here, a position where the end of a sheet S is supported is a region extending from an end of the sheet S to a position that is away from the end of the sheet S to the inside of the sheet S by the diameter of the second protrusion 354.

[Structure of Back Surface of Suction Sheet]

Next, an example of the structure of the back surface of the suction sheet will be described. The example of the structure of the back surface of the suction sheet 330 to be described below is exemplary, and the suction sheet 330 properly forms a structure, which can generate suction pressure in the suction holes 350 shown in FIG. 5, as the structure of the back surface of the suction sheet. The back surface of the suction sheet is the surface of the suction sheet that is opposite to the support surface 304 and is in contact with the body part 336. The back surface of the suction sheet is shown in FIG. 9 and denoted by reference numeral 330A.

Figure 8:
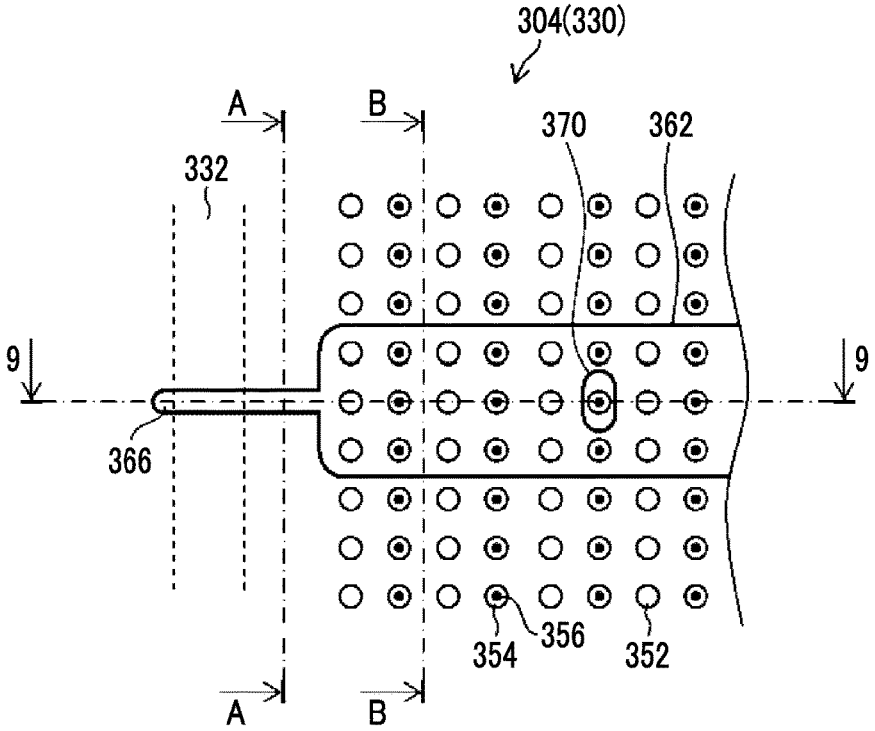
FIG. 8 is a perspective plan view of a support surface.

FIG. 8 is a perspective plan view of the support surface. FIG. 9 is a cross-sectional view taken along line 9-9 of FIG. 8. FIG. 8 is a diagram of the suction sheet 330 and the body part 336 viewed from the support surface 304. FIG. 8 enlarges a part of the third sealed portion 305C shown in FIG. 6.

As shown in FIG. 8, the suction groove 362, an orifice portion 366, and a rib 370 are provided on the back surface of the suction sheet 330. One suction groove 362, one orifice portion 366, and one rib 370 are shown in FIG. 8, but a plurality of suction grooves 362, a plurality of orifice portions 366, and a plurality of ribs 370 are provided on the back surface of the suction sheet 330.

In other words, the plurality of suction grooves 362, the plurality of orifice portions 366, and the plurality of ribs 370 are arranged on the back surface of the suction sheet 330 according to a predetermined arrangement pattern so as to correspond to the arrangement of the transport drum-suction grooves 332 provided on the body part 336. The transport drum-suction groove 332 is shown in FIG. 8 by a broken line.

One suction groove 362 is connected to one or more orifice portions 366. An aspect in which one suction groove 362 is connected to one orifice portion 366 is exemplified in FIG. 8 but, for example, one orifice portion 366 may be connected to each of both sides of one suction groove 362.

The orifice portion 366 has a structure in which the suction groove 362 is narrowed. The structure in which the suction groove 362 is narrowed is, for example, a structure in which the width of the orifice portion 366 is smaller than the width of the suction groove 362. The width of the orifice portion 366 is the length of the orifice portion 366 in a lateral direction in FIG. 8. The width of the suction groove 362 is the length of the suction groove 362 in the lateral direction in FIG. 8.

The structure in which the suction groove 362 is narrowed is, for example, a structure in which the cross-sectional area of the cross-section of the orifice portion 366 taken along line A-A is smaller than the cross-sectional area of the cross-section of the suction groove 362 taken along line B-B. Line A-A and line B-B of FIG. 8 are parallel to each other.

The orifice portion 366 is connected to the suction flow passage of the body part 336, which is shown in FIG. 4, through the transport drum-suction groove 332. The position of the orifice portion 366 on the support surface 304 of the suction sheet 330 corresponds to the unopen region.

It is preferable that the length of the orifice portion 366 in the lateral direction is in the range of 0.2 mm to 5.0 mm. It is more preferable that the length of the orifice portion 366 in the lateral direction is in the range of 1.0 mm to 3.0 mm. The lateral direction of the orifice portion 366 is the circumferential direction of the transport drum 300 in a state in which the suction sheet 330 is mounted on the body part 336.

It is preferable that the length of the orifice portion 366 in a longitudinal direction is in the range of 2.0 mm to 10.0 mm. The longitudinal direction of the orifice portion 366 is a direction parallel to the direction of the rotating shaft 302 of the transport drum 300 in a state in which the suction sheet 330 is mounted on the body part 336.

The rib 370 is provided in the suction groove 362. The rib 370 has a thickness equal to the depth of the suction groove 362. An aspect in which one rib 370 is provided in one suction groove 362 is exemplified in FIG. 8 but, for example, a plurality of ribs 370 may be provided in one suction groove 362.

As long as the flow rate of air in the suction groove 362, which is required for the suction of the sheet S, can be ensured, the shape and size of the rib 370 and the number of ribs 370 are not limited. Since the rib 370 is provided, the recess of the support surface 304 to be formed during the suction of the sheet S is suppressed.

A plurality of suction grooves 362, a plurality of orifice portions 366, and a plurality of ribs 370 each of which is shown in FIG. 8 are arranged on the entire back surface of the suction sheet 330 according to a predetermined arrangement pattern.

As shown in FIG. 9, the suction groove 362 is connected to the protrusion-suction holes 356. In other words, the protrusion-suction holes 356 are perforated in the suction sheet 330 and have a length reaching the suction groove 362.

As shown in FIG. 9, the suction flow passage 333 is formed in the body part 336. The suction flow passage 333 is connected to the transport drum-suction grooves 332 through the transport drum-suction holes 338. The suction flow passage 333 is connected to the second pressure generating device 146 shown in FIG. 2 through a flow passage and a pipe (not shown).

An aspect in which the suction holes 350, the first protrusions 352, and the second protrusions 354 are arranged on the support surface 304 of the suction sheet 330 and the suction grooves 362, the orifice portions 366, and the ribs 370 are arranged on the back surface 330A of the suction sheet 330 opposite to the support surface 304 is exemplified in this embodiment, but the suction sheet 330 may have a structure in which two sheets are laminated.

The suction holes 350, the first protrusions 352, and the second protrusions 354 are formed on one sheet of the two sheets, and the suction grooves 362, the orifice portions 366, and the ribs 370 are arranged on the other sheet of the two sheets. Further, the surface of one sheet on which the holes and the protrusions are not arranged is joined to the surface of the other sheet on which the suction grooves, the orifice portions, and the ribs are not arranged, so that a sheet structure having the same structure as the suction sheet 330 shown in FIG. 9 can be formed.

The example of the structure of the back side of the third sealed portion 305C has been described here, but the structure of the back side of each of the first and second sealed portions 305A and 305B shown in FIG. 5 is also the same as the above-mentioned example of the structure. Further, the suction holes 350 are connected to the suction grooves 362 in a region where the second protrusions 354 are not arranged and the suction holes 350 are arranged.

As the thickness of a region of the suction sheet 330 where the suction grooves 362, the orifice portions 366, and the ribs 370 are arranged is smaller, a larger suction force can be obtained using lower negative pressure. On the other hand, in a case in which the thickness of the region of the suction sheet 330 where the suction grooves 362, the orifice portions 366, and the ribs 370 are arranged is excessively small, clogging caused by foreign materials, such as paper powder and dust, is likely to occur.

Considering this condition, it is preferable that the thickness of the region of the suction sheet 330 where the suction grooves 362, the orifice portions 366, and the ribs 370 are arranged is in the range of 0.05 mm to 0.5 mm in a case in which stainless steel is used to produce the suction sheet 330.

It is preferable that the thickness of a region of the suction sheet 330 where the suction holes 350 are formed is in the range of 0.1 mm to 0.5 mm in a case in which stainless steel is used to produce the suction sheet 330. It is more preferable that the thickness of the region of the suction sheet 330 where the suction holes 350 are formed is in the range of 0.2 mm to 0.3 mm.

In a case in which a material other than stainless steel is used, the suction sheet 330 is designed to have a proper thickness in consideration of the stiffness and flexibility of the material to be used.

[Description of Suction Hole]

A circular shape can be employed as the shape of the opening of the suction hole 350 shown in FIG. 6. Alternatively, an elliptical shape can be employed as the shape of the opening of the suction hole 350. In addition, a polygonal shape can be employed as the shape of the opening of the suction hole 350.

In a case in which an elliptical shape is employed as the shape of the opening of the suction hole 350, the length of a major axis can be set to 2 mm. Further, the length of the minor axis can be set to 1.5 mm.

That is, in a case in which an elliptical shape is employed as the shape of the opening of the suction hole 350, it is preferable that a ratio of the length of the minor axis to the length of the major axis of the elliptical shape is in the range of 0.5 to 1.0. It is more preferable that a ratio of the length of the minor axis to the length of the major axis of the elliptical shape is in the range of 0.7 to 0.9.

In a case in which the shape of the opening of the suction hole 350 is a polygonal shape, such as a hexagonal shape, the opening ratio of the suction sheet 330 is increased. Here, the opening ratio can be represented by a ratio of the sum of the opening areas of the suction holes 350 to the area of a region where the suction holes 350 can be formed.

Suction pressure, which is to be applied to the sheet S, is obtained by adding suction pressure per unit area to the sum of the opening areas of the suction holes 350. The suction pressure mentioned here is obtained by subtracting pressure loss, which is generated to the suction holes 350 from the first pressure generating device 144 or the second pressure generating device 146, from pressure that is generated by the first pressure generating device 144 or the second pressure generating device 146 shown in FIG. 2.

Accordingly, since suction pressure per unit area is constant, it is possible to relatively increase the suction pressure, which is to be applied to the sheet S, by relatively increasing the sum of the opening areas of the suction holes 350.

The upper limit of suction pressure, which is to be applied to the sheet S, is determined according to conditions where the recess of the suction sheet 330 and the recess of the sheet S are not generated.

[Description of Length of Sealed Portion in Sheet Width Direction]

Figure 10:
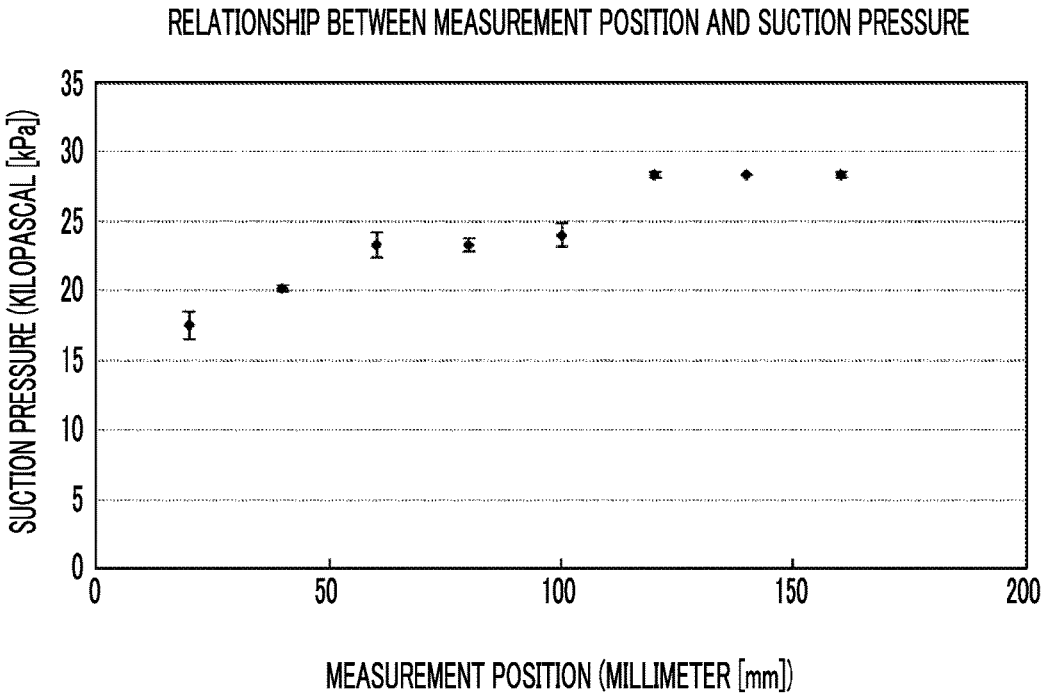
FIG. 10 is a graph showing the effect of the sealed portions according to the first embodiment.

FIG. 10 is a graph showing the effect of the first embodiment. The horizontal axis of a graph shown in FIG. 10 represents a measurement position. The measurement position means a distance from the end of a sheet in the sheet width direction. The unit of the measurement position is millimeter. The vertical axis of the graph shown in FIG. 10 represents suction pressure applied to a sheet S. The unit of the suction pressure is kilopascal.

The measurement of a relationship between the measurement position and the suction pressure shown in FIG. 10 is performed according to the following procedure. First, a sheet S is sucked and supported on the transport drum 300 where only the first protrusions 352 are arranged on the support surface 304. Holes are bored at measurement positions of the sheet S, each hole is closed by a measuring part of a pressure measuring unit, and a measured value, which is measured at each measurement position by the pressure measuring unit, is referred to as a suction pressure value of each measurement position. The diameter of each hole of the sheet S is set to 3 mm so as to correspond to the size of the measuring part of the pressure measuring unit.

Figure 11:
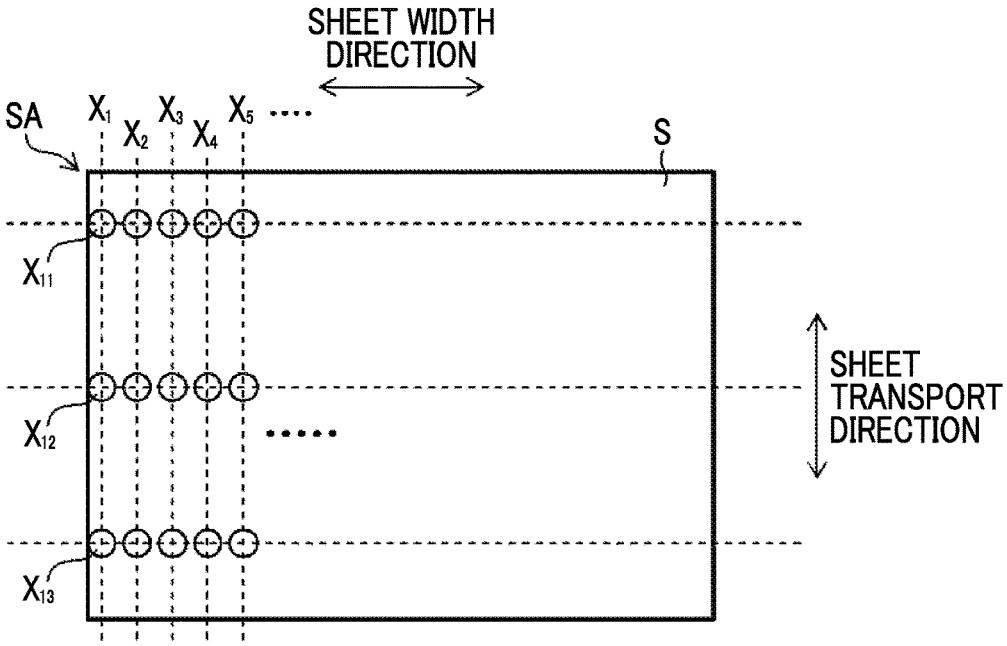
FIG. 11 is a diagram illustrating measurement positions.

FIG. 11 is a diagram illustrating the measurement positions. As shown in FIG. 11, measurement positions $X_1$, $X_2$, $X_3$, $X_4$, and $X_5$ are specified by distances from one end SA of the sheet in the sheet width direction. Measurement is performed at three points arranged in the sheet transport direction at each measurement position, and an average value of three measured values is used as a measured value at each measurement position. For example, in the measurement at the measurement position $X_1$, measurement is performed at three points of $X_{11}$, $X_{12}$, and $X_{13}$ arranged in the sheet transport direction and an average value of measured values is used as a measured value at the measurement position $X_1$.

The measurement of a relationship between the measurement position and the suction pressure shown in FIG. 10 is performed under the following measurement conditions. The output of the pressure generating device, which generates suction pressure in the suction holes, is set to 20 kPa. OK TOP COAT PLUS manufactured by Oji Paper Co., Ltd. is used as the sheet S. OK TOP COAT PLUS is a trade name.

Basis weight, which represents the thickness of the used sheet S, is 157 g/m$^2$. In a case in which the thickness of the used sheet S is expressed in units of length, the thickness of the used sheet S is 131 μm. All of them are values that are publicized in a catalog of Oji Paper Co., Ltd. In regard to the size of the used sheet S, the length of one side of the sheet S is 750 mm and the length of the other side orthogonal to one side is 532 mm.

Handy Manometer PG-100N-102R manufactured by Nidec Copal Electronics Corporation is used as the pressure measuring unit.

As shown in FIG. 10, suction pressure is further reduced between one end SA of the sheet S and a position, which is away from one end SA of the sheet S by 100 mm, in the sheet width direction in comparison with at a position that is away from one end of the sheet S by 100 mm or more. Accordingly, in regard to each size of a sheet S, 100 mm may be set as the length of a sealed portion in the sheet width direction.

In other words, each end portion of the sheet S in the sheet width direction, which is supported by the sealed portion, can be set as a region that is within 100 mm from the end of the sheet S in the sheet width direction.

That is, the floating and folding of the end portions of the sheet in the sheet width direction are suppressed in a case in which the length of each of the first sealed portion 305A, the second sealed portion 305B, and the third sealed portion 305C shown in FIG. 3 in the sheet width direction is set to 100 mm or more.

As the thickness of the sheet S is relatively smaller, the floating of only ends of the sheet in the sheet width direction tends to occur in a case in which suction pressure is reduced. There is a risk that the sheet S may be rubbed against the liquid jetting head due to the floating of the sheet S.

However, in the suction and support of the sheet S performed by the transport drum 300 shown in this embodiment, the floating and folding of the end portions of a sheet S, which has a thickness of 0.2 mm or less and is generally categorized into a thin sheet, in the sheet width direction can also be suppressed.

FIG. 10 shows the results of measurement of one kind of sheet S having one kind of size, but it is thought that a tendency for suction pressure, which is generated at the end portions of the sheet in the sheet width direction, to be reduced in comparison with suction pressure generated at the other regions of the sheet is the same even though the kind of sheet S or the size of a sheet S is changed.

The reason for this is that it is thought that air permeability, which is the degree of permeation of air, of the sheet S is changed due to a difference in the kind of sheet S and suction pressure over the entire sheet S is consequently changed due to a change in air permeability but a tendency for suction pressure to be reduced due to a difference in the position of the sheet S is not changed.

That is, the tendency of the results of measurement shown in FIG. 10 is not limited by the kind, size, and thickness of the sheet S, and is widely applied to a plurality of kinds of sheets S.

[Functional Effect of First Embodiment]

According to the transport drum having the above-mentioned structure, since the second protrusions 354 including the protrusion-suction holes 356 are arranged on the support surface 304 as sealed portions so as to correspond to the end portions of the sheet S in the sheet width direction, the inflow of air to the region where the suction holes 350 are arranged from the outside of the sheet S is restricted.

Accordingly, the leakage of suction pressure at the end portions of the sheet S in the sheet width direction is suppressed, so that the floating of the end portions of the sheet S in the sheet width direction is suppressed.

Further, since the first and second protrusions 352 and 354 are arranged on the support surface 304, the deformation of the sheet S can be absorbed between the first protrusions 352, between the second protrusions 354, or between the first and second protrusions 352 and 354 even though the sheet S, which is transported while being supported by the support surface 304, is significantly deformed. Accordingly, the stable transport of the sheet S where creases, floating, and the like are suppressed is realized.

The end portions of the sheet S in the sheet width direction can be sucked and supported by suction pressure that is generated in the protrusion-suction holes 356 formed in the second protrusions 354.

Since the suction holes 350 are not arranged in the sealed portions, the leakage of suction pressure from spaces between the first and second protrusions 352 and 354 and spaces between the second protrusions 354 is suppressed.

Since the first sealed portions 305A, the second sealed portions 305B, and the third sealed portions 305C are arranged so as to correspond to a plurality of sizes of sheets S, the floating of the end portions of the sheet S in the sheet width direction is suppressed.

Since the first protrusions 352 are arranged on the sealed portions, the deformation of the sheet S is suppressed at the seated portions.

in an aspect including a liquid jetting head, the contact between the jetting surface of the liquid jetting head and the sheet S is prevented by the prevention of the floating of the sheet S. On the other hand, there is a concern that the liquid jetting head and a sheet S may come into contact with each other in the invention disclosed in JP2013-151149A and the invention disclosed in JP2000-191175A.

It is preferable that the height of the first protrusion 352 is equal to the height of the second protrusion 354. Further, in terms of the stable transport of a sheet S, it is preferable that the height of the first protrusion 352 and the height of the second protrusion 354 are set to 50 μm or less.

Rotational transport using the transport drum 300 is exemplified as means for transporting a sheet S in this embodiment, but the same effect can be obtained in a case in which the structure shown in this embodiment is formed even in regard to horizontal transport, such as belt transport.

Since a sheet S is sucked and supported on the curved surface in the rotational transport using the transport drum 300, the floating of a sheet S is more likely to occur than in a case in which the sheet S is sucked and supported on the flat surface. In a case in which a sufficient effect can be obtained in the rotational transport using the transport drum 300, a sufficient effect can be obtained even in the horizontal transport in which the floating of a sheet S is harder to occur than that in the rotational transport using the transport drum 300.

The transport drum 300 having a structure in which the suction sheets 330 are wound on the body part 336 is exemplified in this embodiment, but the structure formed in the suction sheet 330 may be formed on the body part 336.

[Description of Sealed Portion According to Second Embodiment]

Next, sealed portions according to a second embodiment will be described in detail. In the following description, a difference between the first and second embodiments will be mainly described and the description of portions common to the first embodiment will be properly omitted.

Figure 12:
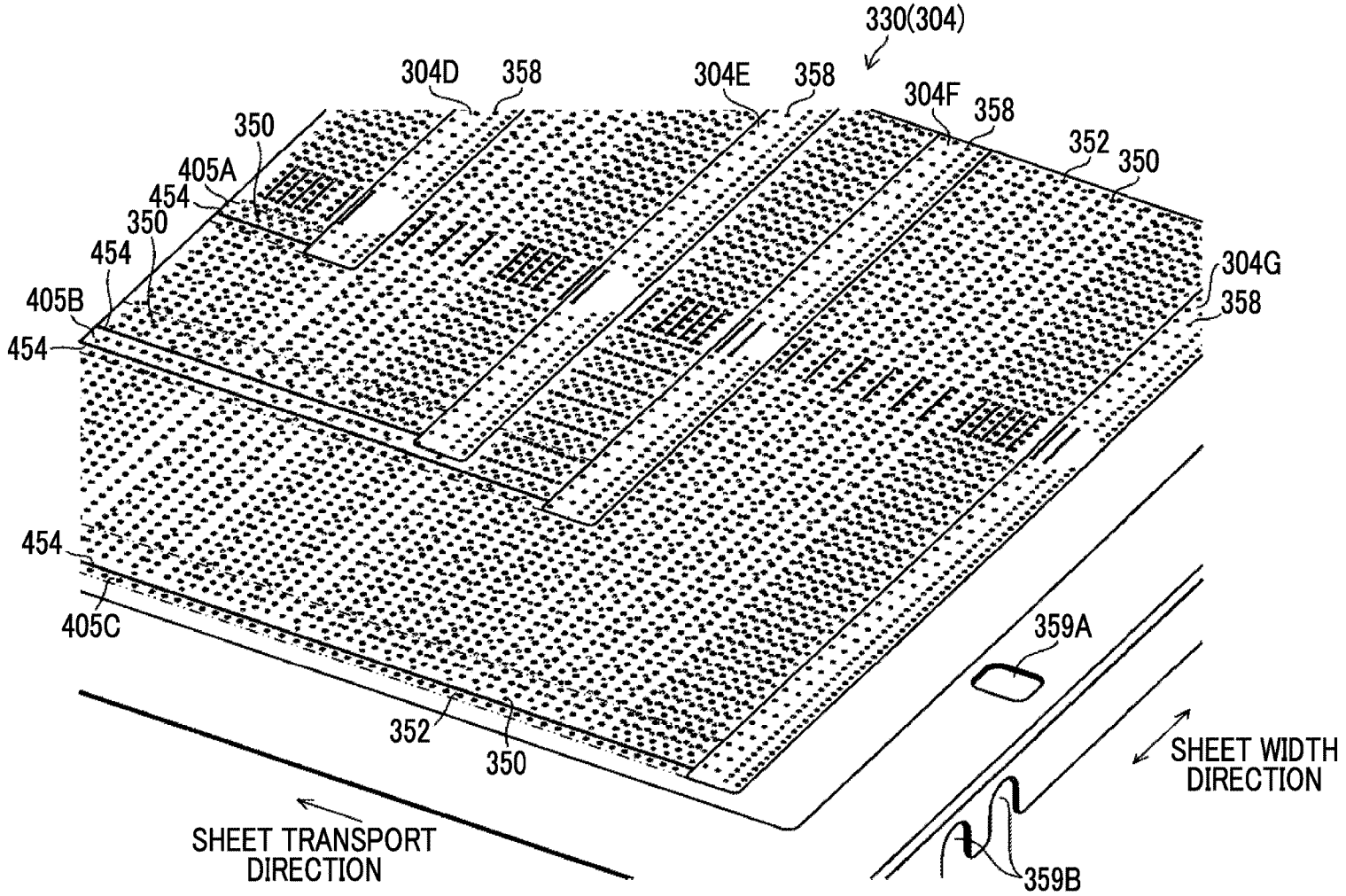
FIG. 12 is a diagram illustrating sealed portions according to a second embodiment.
Figure 13:
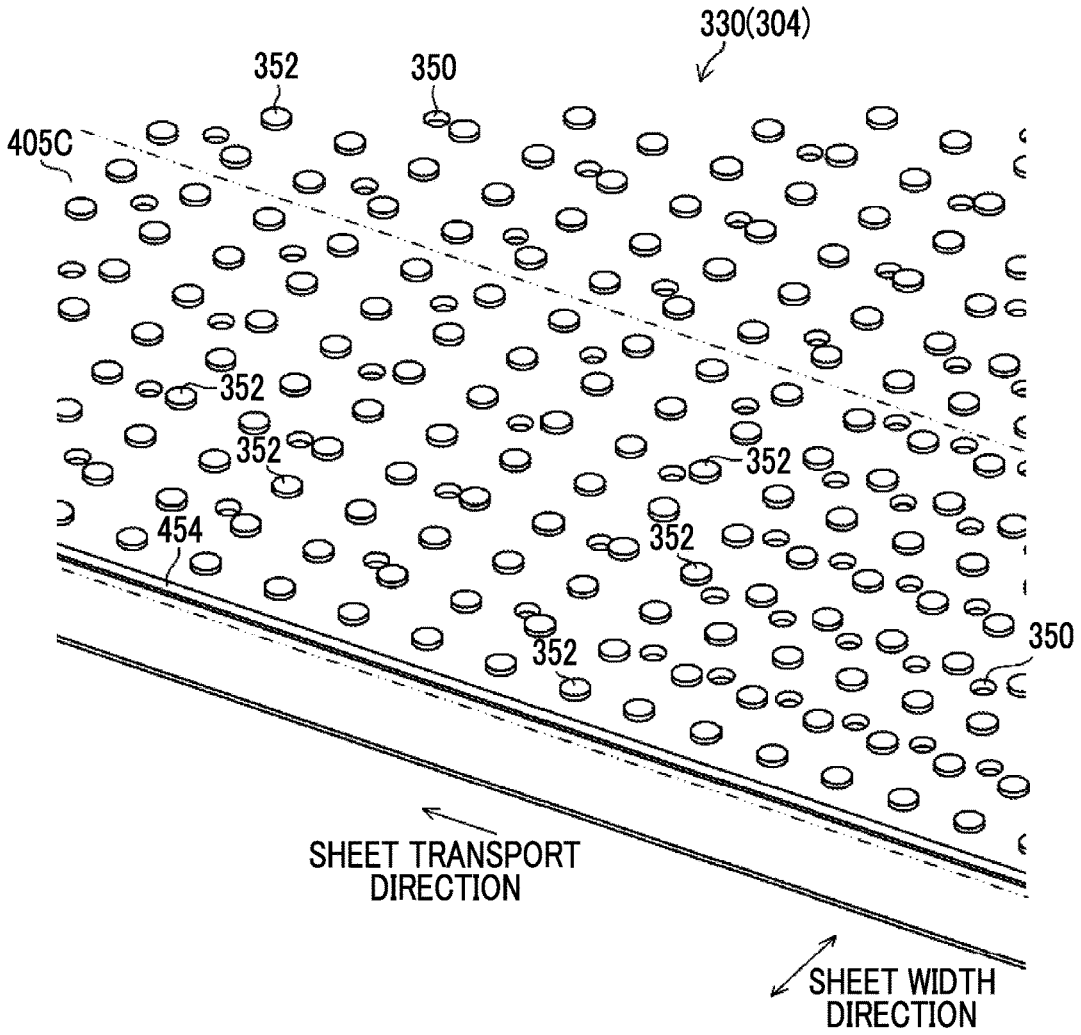
FIG. 13 is an enlarged view of a part of FIG. 12.

FIG. 12 is a diagram illustrating sealed portions according to the second embodiment. FIG. 13 is an enlarged view of a part of FIG. 12. FIG. 13 enlarges a part of a sixth sealed portion 405C shown in FIG. 12.

Each of fourth sealed portions 405A, fifth sealed portions 405B, and sixth sealed portions 405C shown in FIG. 12 is provided with a frame 454. The fifth sealed portion 405B is provided with the frame 454 corresponding to a sheet S having a second size and a frame corresponding to a third size.

Further, suction holes 350 are arranged in the fourth sealed portions 405A, the fifth sealed portions 405B, and the sixth sealed portions 405C shown in FIG. 12. On the other hand, the second protrusions 354 shown in FIG. 5 are not arranged in the fourth sealed portions 405A, the fifth sealed portions 405B, and the sixth sealed portions 405C shown in FIG. 12.

The frame 454 has a shape extending in the sheet transport direction. It is preferable that the positions of the frames 454 in the sheet width direction are position where the frames 454 support both ends of a sheet S. The positions of the frames 454 in the sheet width direction may be positions that are present inside ends of the sheet S and are away from the ends of the sheet S by a certain length, It is preferable that the positions away from the ends of the sheet S by a certain length are positions closer to both ends of the sheet S in the sheet width direction. An aspect in which the frame 454 is disposed on the outermost side of the sixth sealed portion 405C in the sheet width direction is shown in FIG. 13.

The positions, which are mentioned here and are away from the ends of the sheet S by a certain length, are regions where the floating of end portions of the sheet S are suppressed by support using the frames 454. The positions, which are away from the ends of the sheet S by a certain length, can be determined in consideration of conditions, such as the thickness of the sheet and an error of the length of the sheet S in the sheet width direction.

The length of the frame 454 corresponds to the length of the sheet S in the sheet transport direction. For example, the length of the frame 454 can be set to be equal to or longer than the length of the sheet S, which is supported by the frames 454, in the sheet transport direction.

Further, the frame 454 may be divided into a plurality of frames in the sheet transport direction. In terms of suppressing the leakage of suction pressure, it is preferable that an interval between the plurality of frames formed in the sheet transport direction is shorter.

The frame 454 may be formed of one frame in the sheet width direction. A plurality of frames 454, which are arranged in the sheet width direction and are arranged so that the positions of the frames 454 in the sheet width direction are changed, may be arranged. In a case in which the plurality of frames 454, which are arranged in the sheet width direction and are arranged so that the positions of the frames 454 in the sheet width direction are changed, are arranged, it is preferable that the length of the plurality of frames 454 is set to a length equal to or longer than the entire length of the sheet S in the sheet transport direction in a case in which the plurality of frames 454 are projected in a direction parallel to the sheet transport direction.

It is preferable that the width of the frame 454 is relatively narrow in the sheet width direction as long as the sheet S can be supported. The reason for this is that the absorption of the deformation of the sheet S is highly likely to be insufficient in a case in which the width of the frame 454 is relatively wide.

The width of the frame 454 depends on the working limit of a working method in a case in which the frame is to be formed. The width of the frame 454 can be set to 0.5 mm like the diameter of the second protrusion 354 described in the first embodiment. Here, the width of the frame 454 is the length of the frame 454 in the sheet width direction.

In this embodiment, the use of a plurality of kinds of sheets S is supposed and the width of the frame 454 is set to 0.5 mm. The height of the frame 454 can be set to be equal to the height of the first protrusion 352.

Since each sealed portion is provided with the frame 454, the leakage of suction pressure to the outside of the support region for a sheet S in the sheet width direction is suppressed on the inside of the frame 454 in the sheet width direction. The frame 454 is an aspect of a third protrusion.

[Effect of Sealed Portion According to Second Embodiment]

Figure 14:
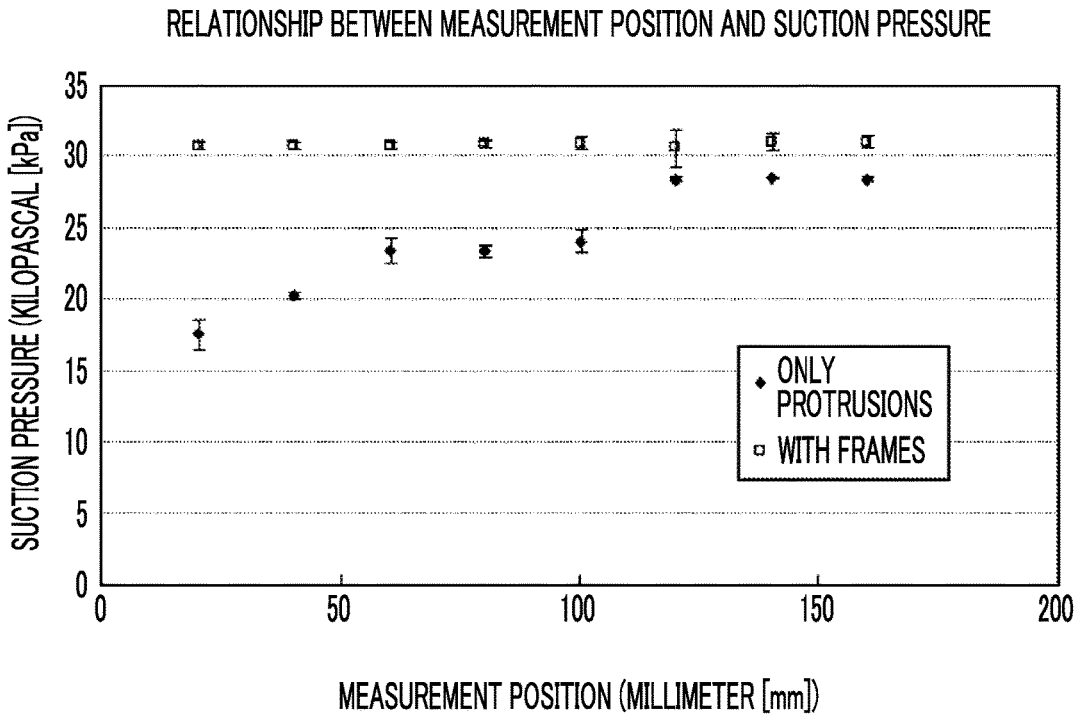
FIG. 14 is a graph showing the effect of the sealed portions according to the second embodiment.

FIG. 14 is a graph showing the effect of the sealed portions according to the second embodiment. Since the horizontal axis and the vertical axis of FIG. 14 are the same as those of FIG. 10, the description thereof will be omitted. Further, since measurement of which results are shown in FIG. 14 is the same as the above-mentioned measurement except for the sealed portions, the description thereof will be omitted here.

The results of measurement shown in FIG. 10 are shown in FIG. 14 together. The results of measurement corresponding to "only protrusions" described in the legend of FIG. 14 are the results of measurement shown in FIG. 10. Further, the results of measurement corresponding to "with frames" described in the legend of FIG. 14 are the results of measurement using the sealed portions according to the second embodiment.

The position of the frame 454 is a position of a measurement position of 0 mm in FIG. 14. The position of a measurement position of 0 mm shown in FIG. 14 corresponds to a position where each end of the sheet S in the sheet width direction is supported. The width of the frame 454 is 0.5 mm. The height of the frame 454 is 50 μm.

A position where each end of the sheet S in the second embodiment is supported is a region extending to a position that is away from the end of the sheet S to the inside of the sheet S by the width of the frame 454.

As shown in FIG. 14, in a case in which the sealed portions according to the second embodiment are used, substantially the same suction pressure as the suction pressure generated at the middle portion of the sheet S in the sheet width direction is maintained even at positions that are away from both ends of the sheet S in the sheet width direction by 20 mm as long as being present on the inside of the frame 454 in the sheet width direction.

In terms of preventing the floating of the sheet at positions that are away from the ends of the sheet S in the sheet width direction by 100 mm, the above-mentioned positions, which are away from the ends of the sheet S by a certain length, can be set to ranges that extend from both ends of the sheet S in the sheet width direction by 100 mm or less.

According to the sealed portions of the second embodiment, the floating of the end portions of the sheet S in the sheet width direction is suppressed as in the case of the sealed portions according to the first embodiment.

Since the frame 454 is formed at each of the fourth sealed portions 405A, the fifth sealed portions 405B, and the sixth sealed portions 405C, the leakage of suction pressure at the end portions of the sheet S in the sheet width direction is suppressed.

Since the suction holes 350 are arranged in the fourth sealed portions 405A, the fifth sealed portions 405B, and the sixth sealed portions 405C, a reduction in suction pressure at the fourth sealed portions 405A, the fifth sealed portions 405B, and the sixth sealed portions 405C is suppressed.

[Coping with Plurality of Sheet Sizes]

An aspect in which with a plurality of sealed portions are provided on one suction sheet 330 so as to correspond to a plurality of sizes of sheets S is exemplified in the first and second embodiments. The plurality of sealed portions, which are mentioned here, are first sealed portions 305A, the second sealed portions 305B, and the third sealed portions 305C shown in FIG. 5 and the fourth sealed portions 405A, the fifth sealed portions 405B, and the sixth sealed portions 405C shown in FIG. 12.

Such an aspect can cope with the sizes of the plurality of sheets S without the replacement of the suction sheet 330.

An aspect, in which one suction sheet 330 includes the sealed portions corresponding to one kind of sheet S, a plurality of kinds of suction sheets 330 are prepared, and the suction sheet 330 wound on the surface 340 of the body part 336 of the transport drum 300 is changed to a suction sheet 330 corresponding to a sheet S to be used in a case in which the size of the sheet S is to be changed, is also preferable.

A local reduction in suction pressure and the generation of a suction mark of a sheet S, which is caused by the presence of sealed portions not corresponding to a sheet S to be actually used, and the like can be suppressed in such an aspect.

Even in an aspect in which a suction sheet 330 corresponding to a sheet S to be used is changed in a case in which the size of a sheet S is to be changed, one suction sheet 330 can also be provided with sealed portions corresponding to the sizes of two or more kinds of sheets S.

In a case in which sheets S having a plurality of sizes are used in the invention disclosed in JP2013-151149A and the invention disclosed in JP2000-191175A, there is a concern that the sheets S may float with regard to the respective sizes.

[Coping with Suction Mark]

Suction marks are left on portions of a sheet S that come into contact with the suction holes 350, the first protrusions 352, the second protrusions 354, the frames 454, and the like. The formation of suction marks, which can cause a problem in terms of quality, needs to be avoided.

In a case in which portions coming into contact with the sheet S, that is, end portions of the suction holes 350, corner portions of first protrusions 352, corner portions of the second protrusions 354, and corner portions of the frames 454 form rounded surfaces, suction marks can become more indistinct.

As the thickness of the sheet S is smaller, suction marks are more likely to be formed on the sheet S. The height of the first protrusion, the second protrusion, or the frame, which allows suction marks to be suppressed, is 0.5 μm or less in regard to the thickness of a sheet S to be supposed in this embodiment. The lower limit of the height of the first protrusion, the second protrusion, or the frame can be determined in terms of preventing the deformation of the sheet S.

The formation of suction marks on the sheet S is suppressed by the above-mentioned countermeasure against suction marks.

[Structure of Liquid Jetting Head]

Next, the structures of the liquid jetting heads shown in FIG. 1 will be described in detail.

<Overall Structure >

Figure 15:
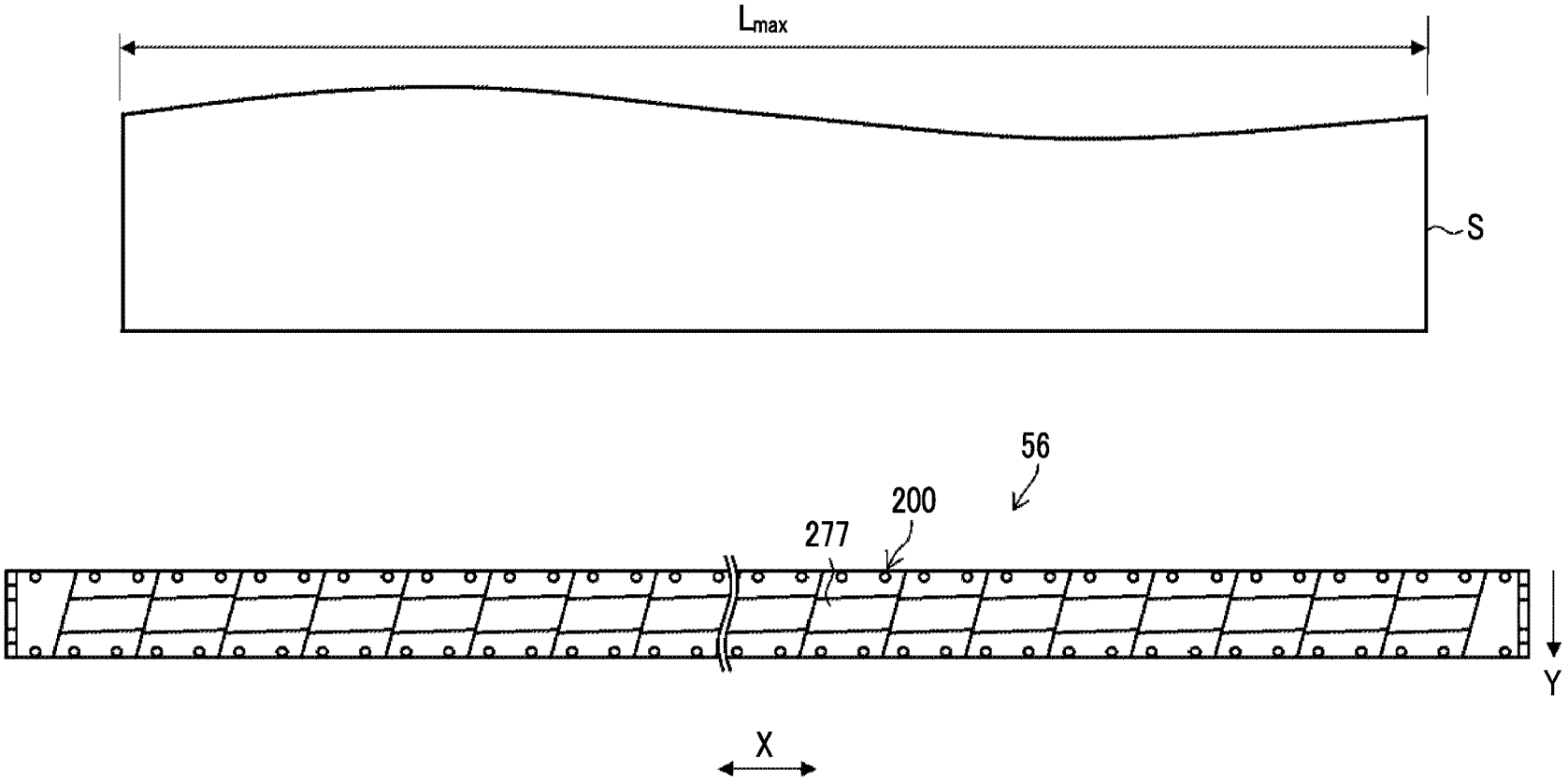
FIG. 15 is a perspective plan view showing an example of the structure of a liquid jetting head.

FIG. 15 is a perspective plan view showing an example of the structure of the liquid jetting head. The same structure can be applied to the liquid jetting head 56C for jetting a cyan ink, the liquid jetting head 56M for jetting a magenta ink, the liquid jetting head 56Y for jetting a yellow ink, and the liquid jetting head 56K for jetting a black ink that are shown in FIG. 1.

In a case in which the liquid jetting heads 56C, 56M, 56Y, and 56K do not need to be distinguished from each other, the liquid jetting heads are denoted by reference numeral 56.

As shown in FIG. 15, the liquid jetting head 56 is a line type head. The line type head has a structure in which a plurality of nozzle parts are arranged over a length exceeding the entire width $L_{max}$ of a sheet S in a direction orthogonal to the sheet transport direction. The nozzle parts are not shown in FIG. 15. The nozzle parts are denoted in FIG. 18 by reference numeral 281. The nozzle part is an aspect of the jetting element.

A direction, which is denoted in FIG. 15 by reference letter X, is a direction orthogonal to the sheet transport direction. The direction orthogonal to the sheet transport direction corresponds to the sheet width direction.

A direction, which is denoted in FIG. 15 by reference letter Y, is the sheet transport direction. The direction orthogonal to the sheet transport direction will be referred to as an X direction. Further, the sheet transport direction is referred to as a Y direction.

The liquid jetting head 56 shown in FIG. 15 includes a plurality of head modules 200. The plurality of head modules 200 are arranged in a line along the direction orthogonal to the sheet transport direction.

The same structure can also be applied to the plurality of head modules 200. Further, the head module 200 has a structure that can function alone as a liquid jetting head.

The liquid jetting head 56 in which the plurality of head modules 200 are arranged in a line along the direction orthogonal to the sheet transport direction is shown in FIG. 15, but the plurality of head modules 200 may be arranged in two lines so that the phases of the head modules 200 are shifted from each other in the sheet transport direction.

Figure 17:
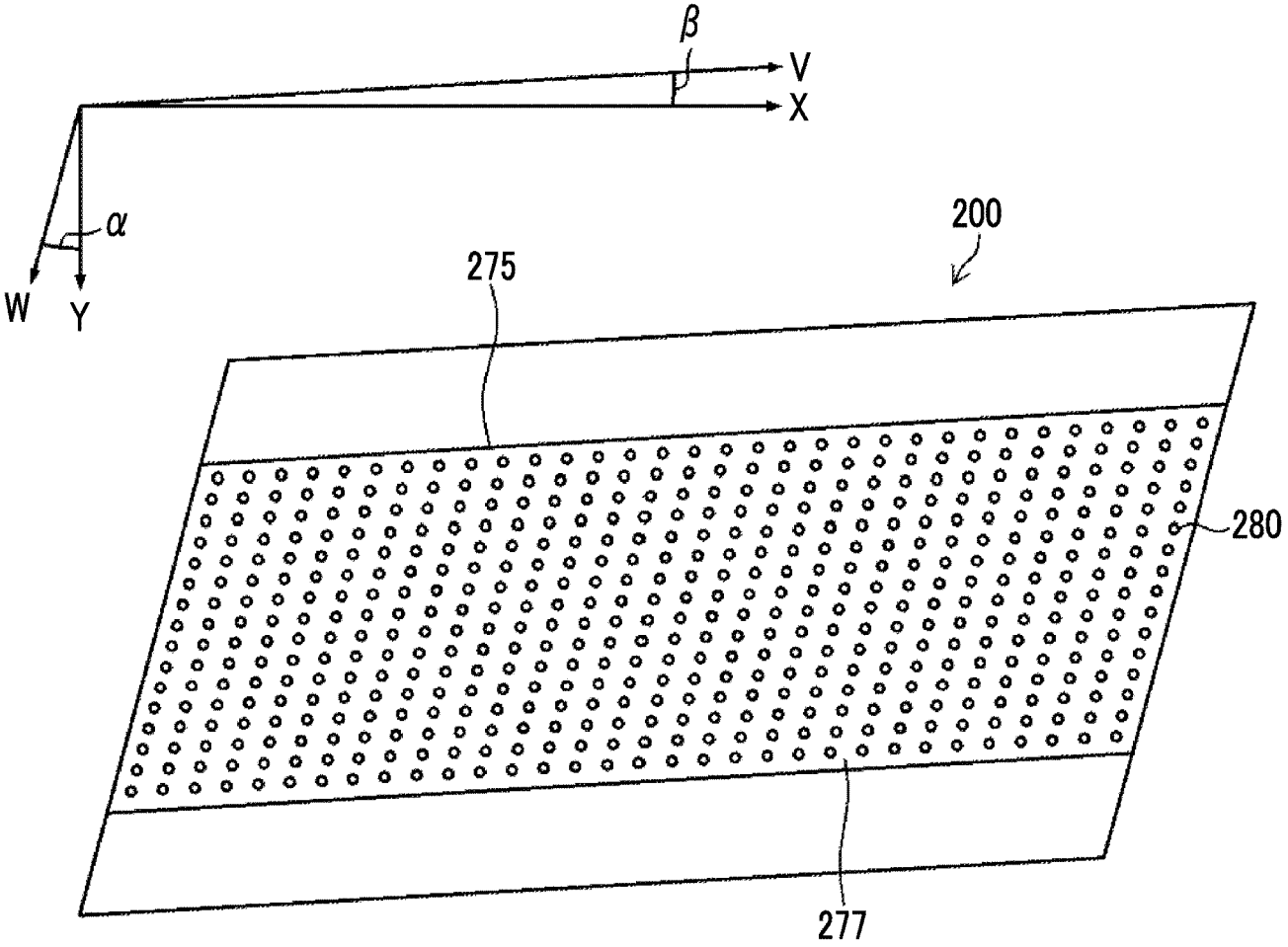
FIG. 17 is a perspective plan view of a liquid jetting surface of the head module.

A plurality of nozzle openings are arranged on jetting surfaces 277 of the head modules 200 of the liquid jetting head 56. The nozzle openings are not shown in FIG. 15. The nozzle openings are shown in FIG. 17 and denoted by reference numeral 280.

The full-line type liquid jetting head 56 is exemplified in this embodiment, but a serial system can also be applied. In the serial system, a short serial type liquid jetting head shorter than the entire width $L_{max}$ of a sheet S is moved in the direction orthogonal to the sheet transport direction to perform the formation of an image corresponding to one time in the direction orthogonal to the sheet transport direction, the sheet S is transported in the sheet transport direction by a certain distance so that the formation of an image in the direction orthogonal to the sheet transport direction is formed in the next region in a case in which the formation of the image corresponding to one time in the direction orthogonal to the sheet transport direction is completed, and this operation is repeated so that the formation of an image is performed on the entire surface of the sheet.

<Example of structure of Head Module>

Next, the head module will be described in detail.

Figure 16:
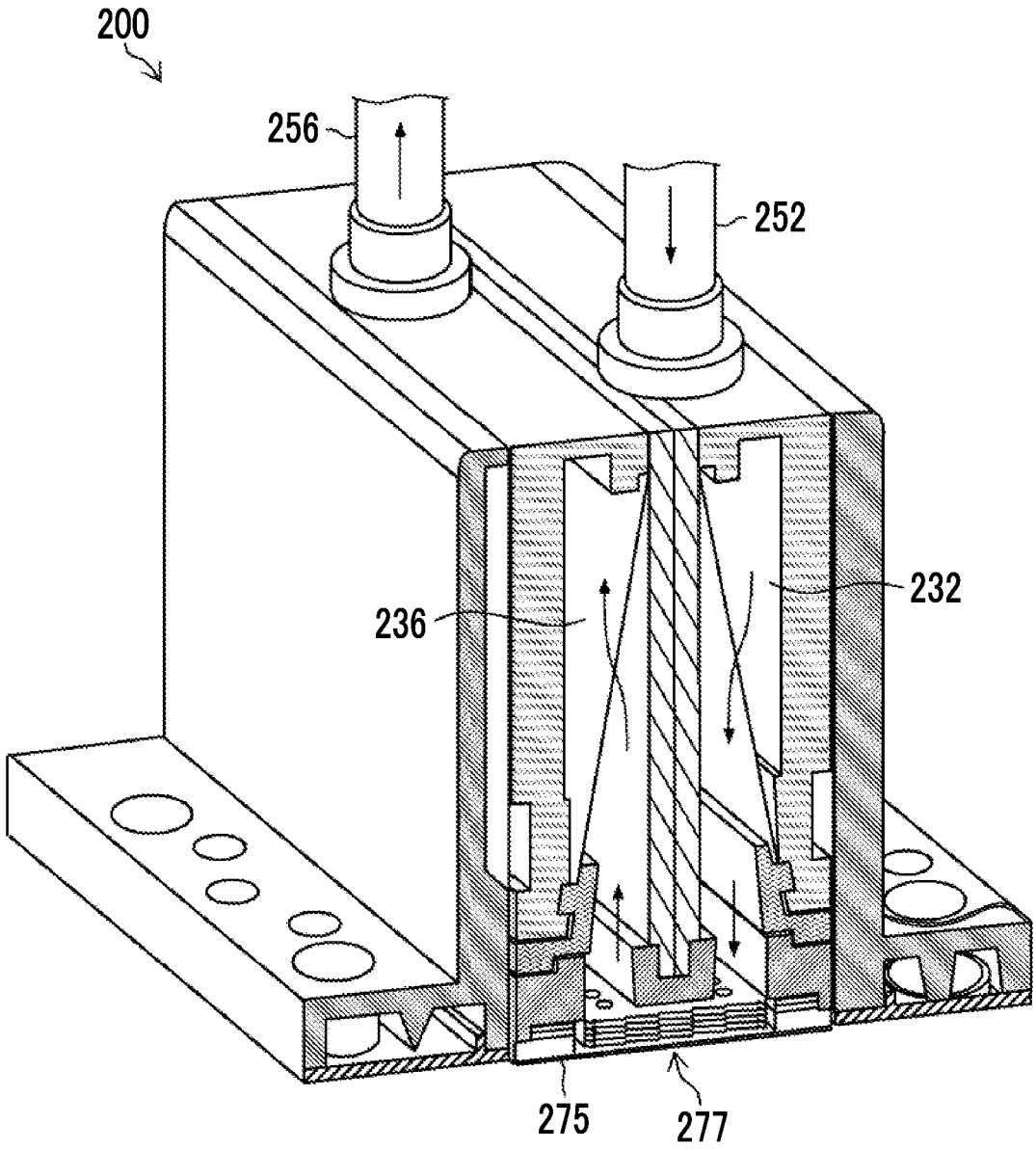
FIG. 16 is a perspective view of a head module including a partial cross-sectional view.

FIG. 16 is a perspective view of the head module including a partial cross-sectional view. FIG. 17 is a perspective plan view of the liquid jetting surface of the head module.

As shown in FIG. 16, the head module 200 includes an ink supply unit. The ink supply unit includes an ink supply chamber 232 and an ink circulation chamber 236.

The ink supply chamber 232 and the ink circulation chamber 236 are disposed on the side opposite to a jetting surface 277 of a nozzle plate 275. The ink supply chamber 232 is connected to an ink tank (not shown) through a supply pipe line 252. The ink circulation chamber 236 is connected to a collection tank (not shown) through a circulation pipe line 256.

Only some of the nozzle openings 280 are shown in FIG. 17, but a plurality of nozzle openings 280 are two-dimensionally arranged on the jetting surface 277 of the nozzle plate 275 of one head module 200.

That is, the head module 200 has the planar shape of a parallelogram that has a long-side end face extending in a V direction having an inclination of an angle β with respect to the X direction and a short-side end face extending in a W direction having an inclination of an angle α with respect to the Y direction, and the plurality of nozzle openings 280 are arranged in the form of a matrix in a row direction parallel to the V direction and a column direction parallel to the W direction.

The arrangement of the nozzle openings 280 is not limited to the aspect shown in FIG. 17, and the plurality of nozzle openings 280 may be arranged in a row direction parallel to the X direction and a column direction obliquely crossing the X direction.

Here, the matrix arrangement of the nozzle openings 280 is the arrangement of the nozzle openings 280 where the arrangement interval of the nozzle openings 280 is uniform in an X-direction projection nozzle array in which the plurality of nozzle openings 280 are arranged along the X direction in a case in which the plurality of nozzle openings 280 are projected in the X direction.

In the liquid jetting head 56 shown in this embodiment, nozzle openings 280 belonging to one head module 200 and nozzle openings 280 belonging to the other head module 200 are mixed at a connecting portion between the adjacent head modules 200 in the X-direction projection nozzle array.

In a case in which there is no error in the mounting position of each head module 200, the nozzle openings 280, which belong to one head module 200, and the nozzle openings 280, which belong to the other head module 200, of a connecting region are arranged at the same positions. Accordingly, the arrangement of the nozzle openings 280 is uniform even in the connecting region.

In the following description, it is assumed that the head modules 200 of the liquid jetting head 56 are mounted with no error in the mounting positions thereof.

<Internal Structure of Head Module>

Figure 18:
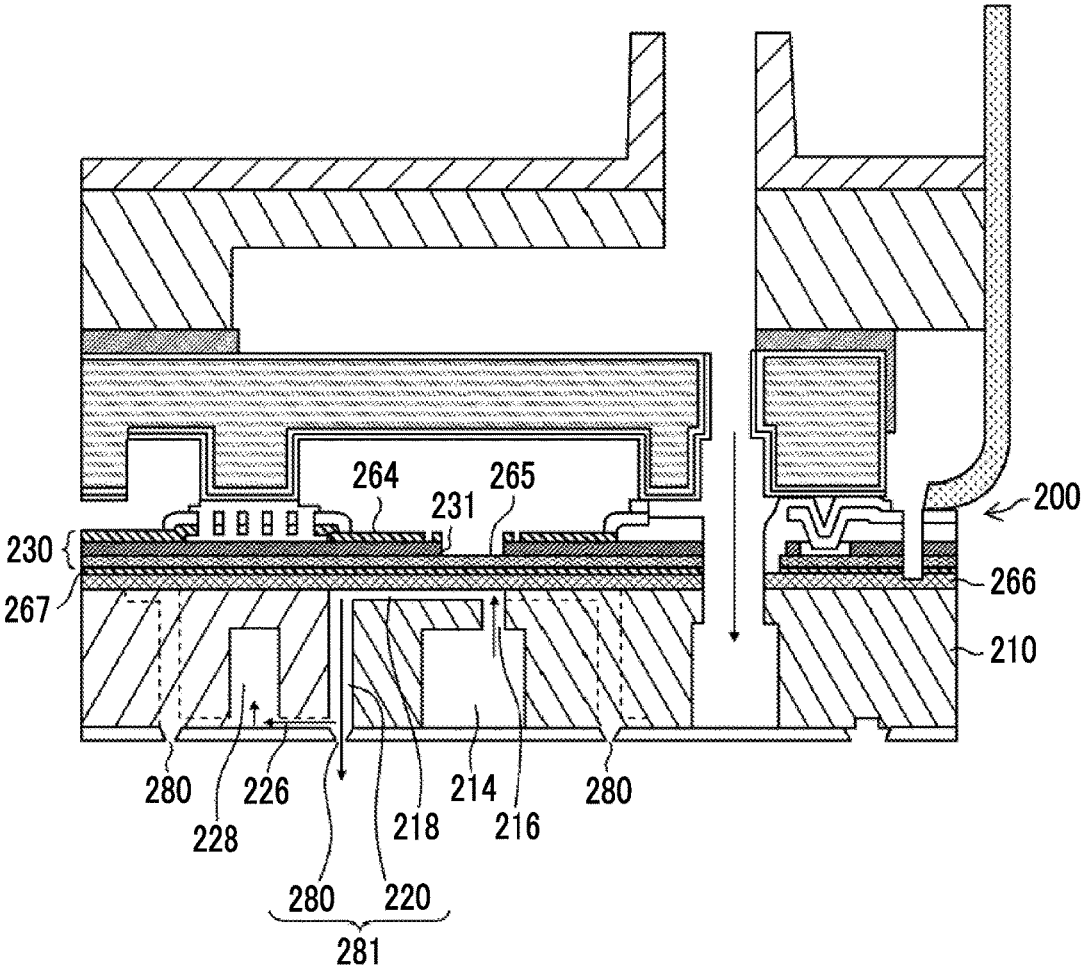
FIG. 18 is a cross-sectional view showing the internal structure of the head module.

FIG. 18 is a cross-sectional view showing the internal structure of the head module. The head module 200 includes an ink supply passage 214, individual supply passages 216, pressure chambers 218, nozzle communication passages 220, individual circulation flow passages 226, a common circulation flow passage 228, piezoelectric elements 230, and a vibrating plate 266.

The ink supply passage 214, the individual supply passages 216, the pressure chambers 218, the nozzle communication passages 220, the individual circulation flow passages 226, and the common circulation flow passage 228 are formed in a flow passage structure 210. The nozzle part 281 includes the nozzle opening 280 and the nozzle communication passage 220.

The individual supply passage 216 is a flow passage that connects the pressure chamber 218 to the ink supply passage 214. The nozzle communication passage 220 is a flow passage that connects the pressure chamber 218 to the nozzle opening 280. The individual circulation flow passage 226 is a flow passage that connects the nozzle communication passage 220 to the common circulation flow passage 228.

A vibrating plate 266 is provided on the flow passage structure 210. The piezoelectric elements 230 are disposed on the vibrating plate 266 with an adhesive layer 267 therebetween. The piezoelectric element 230 has a structure in which a lower electrode 265, a piezoelectric layer 231, and an upper electrode 264 are laminated. The lower electrode 265 is called a common electrode, and the upper electrode 264 is called an individual electrode.

The upper electrode 264 is formed of an individual electrode that is patterned so as to correspond to the shape of each pressure chamber 218, and the piezoelectric element 230 is provided for each pressure chamber 218.

Since the ink supply passage 214 is connected to the ink supply chamber 232 described in FIG. 16, ink is supplied to the pressure chamber 218 from the ink supply passage 214 through the individual supply passage 216. In a case in which a drive voltage is applied to the upper electrode 264 of the piezoelectric element 230 provided for the corresponding pressure chamber 218 according to image data, the piezoelectric element 230 and the vibrating plate 266 are deformed and the volume of the pressure chamber 218 is changed. Ink is jetted from the nozzle opening 280 through the nozzle communication passage 220 due to a change in pressure that is caused by a change in the volume of the pressure chamber 218.

It is possible to jet ink droplets from the nozzle openings 280 by controlling the drive of the piezoelectric elements 230 corresponding to the respective nozzle openings 280 according to dot data that is generated from the image data. The ink droplet is an aspect of liquid.

In a case in which timings where ink droplets are jetted from the respective nozzle openings 280 are controlled according to the transport speed of a sheet S while the sheet S is transported in the sheet transport direction at a certain speed, a desired image is formed on the sheet S.

Although not shown, the planar shape of the pressure chamber 218 provided so as to correspond to each nozzle opening 280 is a substantially square shape, an outlet, which is to be connected to the nozzle opening 280, is provided at one corner portion of both corner portions positioned on a diagonal line, and the individual supply passage 216, which is an inlet for ink to be supplied, is provided at the other corner portion thereof.

The shape of the pressure chamber is not limited to a square shape. The planar shape of the pressure chamber may be various shapes, such as a quadrangular shape (a rhombic shape, a rectangular shape, and the like), a pentagonal shape, a hexagonal shape, other polygonal shapes, a circular shape, an elliptical shape, and the like.

A circulation outlet (not shown) is formed at the nozzle part 281 that includes the nozzle opening 280 and the nozzle communication passages 220. The nozzle part 281 communicates with the individual circulation flow passage 226 through the circulation outlet. Ink, which is not used for jetting, of ink of the nozzle part 281 is collected to the common circulation flow passage 228 through the individual circulation flow passage 226.

The common circulation flow passage 228 is connected to the ink circulation chamber 236 described in FIG. 16. Since ink is normally collected to the common circulation flow passage 228 through the individual circulation flow passage 226, the thickening of ink of the nozzle part in a case in which ink is not jetted is prevented.

The internal structure of the head module 200 is not limited to the structure shown in FIGS. 15 to 18. In regard to the arrangement of the nozzle openings 280 and the nozzle parts 281, the nozzle openings 280 and the nozzle parts 281 may be arranged in a line in the sheet width direction and may be arranged in two or more lines.

The piezoelectric element 230 having a structure individually separated so as to correspond to each nozzle part 281 is exemplified in FIG. 18 as an example of a piezoelectric element. Of course, a structure in which the piezoelectric layer 231 is integrally formed so as to correspond to the plurality of nozzle parts 281, the individual electrode is formed so as to correspond to each nozzle part 281, and an active region is formed for each nozzle part 281 may be applied.

A thermal system, which includes a heater provided in the pressure chamber 218, supplies a drive voltage to the heater to allow the heater to generate heat, and uses a film boiling phenomenon to jet ink, which is present in the pressure chamber 218, from the nozzle opening 280, may be applied as a pressure generating element instead of the piezoelectric element.

The ink jet recording apparatus is exemplified in this specification as an example of the image forming system, but the image forming system is not limited to an image forming system using liquid such as ink. The above-mentioned medium sorting can also be applied to the electrographic image forming system using, for example, toner. The image forming system disclosed in this specification can be read as an image forming apparatus.

The image forming system using treatment liquid is exemplified as an example of the image forming system in this specification, but the above-mentioned medium sorting can also be applied to an image forming system that forms an image without using treatment liquid.

The embodiments of the invention described above can be properly subjected to the modification, addition, and deletion of components without departing from the scope of the invention. The invention is not limited to the above-mentioned embodiments, and can be modified in various ways by those skilled in the art without departing from the scope of the invention.

EXPLANATION OF REFERENCES

10: ink jet recording apparatus
11: transport system
12: sheet feed section
14: treatment liquid applying section
16: treatment liquid-drying processing section
18: drawing section
20: ink-drying processing section
24: sheet discharge section
30: sheet feed tray
32: sucker device
34: pair of sheet feed rollers
36: feeder board
36A: retainer
36B: guide roller
38: front stopper
40: sheet feed cylinder
40A, 42A, 46A, 52A, 64D: gripper
40B, 46B, 52B, 302: rotating shaft
42: treatment liquid cylinder
42C, 52C: outer peripheral surface

44: treatment liquid applying device
46: treatment liquid-drying processing cylinder
46C: outer peripheral surface
48: sheet transport guide
50: treatment liquid-drying processing unit
52: drawing cylinder
54: sheet pressing roller
56, 56C, 56K, 56M, 56Y: liquid jetting head
58: in-line sensor
64: chain gripper
64A: first sprocket
64B: second sprocket
64C: chain
68: ink drying processing unit
72, 73: guide plate
76: sheet discharge tray
100: system controller
100A: CPU
100B: ROM
100C: RAM
102: communication section
103: host computer
104: image memory
110: transport control section
112: sheet feed control section
114: treatment liquid-application control section
116: treatment liquid-drying control section
118: drawing control section
120: ink-drying control section
124: sheet discharge control section
130: operation section
132: display section
134: parameter storage section
136: program storage section
140: first pressure control section
142: second pressure control section
144: first pressure generating device
146: second pressure generating device
200: head module
210: flow passage structure
214: ink supply passage
216: individual supply passage
218: pressure chamber
220: nozzle communication passage
226: individual circulation flow passage
228: common circulation flow passage
230: piezoelectric element
231: piezoelectric layer
232: ink supply chamber
236: ink circulation chamber
252: supply pipe line
256: circulation pipe line
264: upper electrode
265: lower electrode
266: vibrating plate
267: adhesive layer
275: nozzle plate
277: jetting surface
280: nozzle opening
281: nozzle part
300: transport drum
304: support surface
304A: first support region
304B: second support region
304D: first sheet-rear-end support region
304E: second sheet-rear-end support region
304F: third sheet-rear-end support region
304G: fourth sheet-rear-end support region
305A: first sealed portion
305B: second sealed portion
305C: third sealed portion
307A, 307B, 307C, 307D: region where sheet is supported
322A, 322B: recessed portion
330: suction sheet
330A: back surface
332: transport drum-suction groove
333: suction flow passage
336: body part
338: transport drum-suction hole
340: surface
342: suction sheet-front-end fixing part
344: suction sheet-rear-end fixing part
350: suction hole
352: first protrusion
354: second protrusion
356: protrusion-suction hole
358: rear-end-suction hole
359A: positioning hole
359B: notched portion
362: suction groove
366: orifice portion.
370: rib
405A: fourth sealed portion
405B: fifth sealed portion
405C: sixth sealed portion
454: frame
$L_{max}$: entire width
S: sheet
SA: one end
X: direction orthogonal to sheet transport direction
$X_1$, $X_2$, $X_3$, $X_4$, $X_5$: measurement position
Y: sheet transport direction
$\alpha$, $\beta$: angle

What is claimed is:

1. An image forming system comprising:

a transport section that includes a support surface supporting a sheet-like medium and transports the medium while supporting the medium on the support surface;

a first pressure generating section that generates pressure used to suck the medium supported on a medium support region of the support surface; and an image forming section that forms an image on the medium transported by the transport section, wherein the medium support region has a structure in which first suction holes communicating with the first pressure generating section are arranged and a structure in which first protrusions to be arranged in a region where the first suction holes are not arranged are arranged, and sealed portions for restricting inflow of air to the first suction holes from the outside of end portions of the medium in a medium width direction, which is a direction orthogonal to a medium transport direction serving as a direction in which the medium is transported by the transport section, are disposed in regions where the end portions of the medium in the medium width direction are supported, wherein each of the sealed portions includes second protrusions that are arranged in the medium support region at a position where the end portion of the medium in the medium width direction is supported, second suction holes that are disposed at distal ends of the second protrusions, and a second pressure generating section that communicates with the second suction holes.

2. The image forming system according to claim 1, wherein the first suction holes are not arranged in the sealed portions.

3. The image forming system according to claim 1, wherein each of the sealed portions further includes a third protrusion that is disposed in a region where the end portion of the medium in the medium width direction is supported and has a length corresponding to a length of the medium in the medium transport direction.

4. The image forming system according to claim 3, wherein the third protrusions are disposed at positions where ends of the medium in the medium width direction are supported.

5. The image forming system according to claim 3, wherein the third protrusion has a length that is equal to or longer than the length of the medium in the medium transport direction.

6. The image forming system according to claim 3, wherein the first suction holes are arranged in the sealed portions.

7. The image forming system according to claim 1, wherein the first protrusions are arranged on the sealed portions.

8. The image foil ling system according to claim 1, wherein the sealed portions are arranged at a plurality of positions so as to correspond to a plurality of sizes of mediums.

9. The image forming system according to claim 1, wherein the transport section has a structure in which a suction sheet is laminated on a surface of a body part, and the first protrusions, the first suction holes, and the sealed portions are arranged on a surface of the suction sheet that forms the support surface.

10. The image forming system according to claim 9, wherein the transport section includes an attachment/detachment unit that attaches and detaches the suction sheet to and from the body part.

11. The image forming system according to claim 1, wherein the transport section includes a transport drum which has a cylindrical shape and of which an outer peripheral surface of the cylindrical shape forms the support surface.

* * * * *